US009939180B2

(12) United States Patent
Susaki et al.

(10) Patent No.: US 9,939,180 B2
(45) Date of Patent: Apr. 10, 2018

(54) HEAT-RECOVERY-TYPE REFRIGERATION APPARATUS

(71) Applicant: DAIKIN INDUSTRIES, LTD., Osaka-shi, Osaka (JP)

(72) Inventors: Mari Susaki, Sakai (JP); Masahiro Oka, Sakai (JP); Ryuuta Ohura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/314,073

(22) PCT Filed: May 20, 2015

(86) PCT No.: PCT/JP2015/064511
§ 371 (c)(1),
(2) Date: Nov. 26, 2016

(87) PCT Pub. No.: WO2015/182458
PCT Pub. Date: Dec. 3, 2015

(65) Prior Publication Data

US 2017/0198944 A1 Jul. 13, 2017

(30) Foreign Application Priority Data

May 28, 2014 (JP) ..... 2014-110073

(51) Int. Cl.
*F25B 13/00* (2006.01)
*F25B 49/02* (2006.01)

(52) U.S. Cl.
CPC ..... *F25B 13/00* (2013.01); *F25B 49/02* (2013.01); *F25B 2313/0231* (2013.01);
(Continued)

(58) Field of Classification Search
CPC .. F25B 13/00; F25B 49/02; F25B 2313/0231; F25B 2313/0233; F25B 2313/0253; F25B 2313/0314; F25B 2313/0315
See application file for complete search history.

(56) References Cited

U.S. PATENT DOCUMENTS 5,065,588 A 11/1991 Nakayama et al.
8,047,011 B2 * 11/2011 Kawano ..... F25B 13/00 62/160
(Continued)

FOREIGN PATENT DOCUMENTS

EP 1 617 158 A2 1/2006
EP 1 635 129 A2 3/2006
(Continued)

OTHER PUBLICATIONS

International Preliminary Report of corresponding PCT Application No. PCT/JP2015/064511 dated Nov. 29, 2016.
(Continued)

*Primary Examiner* — Marc Norman

(57) ABSTRACT

In a refrigeration apparatus, in a first operation mode, a comparison is made between a first liquid pipe temperature, which is a temperature of a refrigerant on a side of a liquid pipe heat exchanger that is near usage-side heat exchangers, and a second liquid pipe temperature, which is a temperature of the refrigerant on a side of the liquid pipe heat exchanger that is near a plurality of heat-source-side heat exchangers, the liquid pipe heat exchanger performing heat exchange with the refrigerant flowing through liquid sides of the heat-source-side heat exchangers. When an evaporation-switch liquid pipe temperature condition is satisfied, the heat-source-side heat exchanger functioning as a radiator of the refrigerant is switched to an evaporator of the refrigerant, and the first operation mode is switched to a second opera-
(Continued)

tion mode in which the plurality of heat-source-side heat exchangers are caused to function as evaporators of the refrigerant.

4 Claims, 9 Drawing Sheets

(52) U.S. Cl.
CPC ..... *F25B 2313/0233* (2013.01); *F25B 2313/0253* (2013.01); *F25B 2313/0315* (2013.01)

(56) References Cited

U.S. PATENT DOCUMENTS

| | | | | |
|---|---|---|---|---|
| 2008/0022710 | A1 | 1/2008 | Jeong et al. | |
| 2012/0260685 | A1 | 10/2012 | Honda | |
| 2013/0081417 | A1 | 4/2013 | Tamura et al. | |
| 2015/0300666 | A1* | 10/2015 | Kawano ..... | F24F 5/001 62/324.1 |
| 2016/0209084 | A1* | 7/2016 | Kawano ..... | F25B 13/00 |

FOREIGN PATENT DOCUMENTS

| | | | |
|---|---|---|---|
| EP | 2 574 866 | A2 | 4/2013 |
| JP | 3-140757 | A | 6/1991 |
| JP | 9-14790 | A | 1/1997 |
| JP | 2006-78026 | A | 3/2006 |
| JP | 2010-139215 | A | 6/2010 |
| JP | 2013-83424 | A | 5/2013 |
| WO | 2011/080802 | A1 | 7/2011 |

OTHER PUBLICATIONS

Notification of Reasons for Refusal of corresponding Japanese Application No. 2014-110073 dated Aug. 4, 2015.
International Search Report of corresponding PCT Application No. PCT/JP2015/064511 dated Aug. 11, 2015.
European Search Report of corresponding EP Application No. 15 80 0124.8 dated Dec. 12, 2017.

* cited by examiner

HEAT-RECOVERY-TYPE REFRIGERATION APPARATUS

CROSS-REFERENCE TO RELATED APPLICATIONS

This U.S. National stage application claims priority under 35 U.S.C. § 119(a) to Japanese Patent Application. No. 2014-110073, filed in Japan on May 28, 2014, the entire contents of which are hereby incorporated herein by reference.

TECHNICAL FIELD

The present invention relates to a heat-recovery-type refrigeration apparatus, and relates particularly to a heat-recovery-type refrigeration apparatus which includes a compressor, a plurality of heat-source-side heat exchangers, and a plurality of usage-side heat exchangers, in which a refrigerant is sent from the usage-side heat exchanger functioning as a radiator of the refrigerant to the usage-side heat exchanger functioning as an evaporator of the refrigerant, whereby heat can be recovered between the usage-side heat exchangers.

BACKGROUND ART

In the past, there have been air-conditioning apparatuses capable of a simultaneous cooling/heating operation, which are a type of heat-recovery-type refrigeration apparatus configured including a compressor, two outdoor heat exchangers as heat-source-side heat exchangers, and a plurality of indoor heat exchangers as usage-side heat exchangers, such as that disclosed in Japanese Laid-open Patent Publication No. 2006-78026. In this heat-recovery-type refrigeration apparatus, the usage-side heat exchangers can be individually switched between functioning as evaporators or radiators of a refrigerant, and heat recovery among the usage-side heat exchangers can be performed by sending the refrigerant from the usage-side heat exchangers functioning as radiators of the refrigerant to the usage-side heat exchangers functioning as evaporators of the refrigerant (in this case, a simultaneous cooling/heating operation can be performed in which an air-cooling operation and an air-heating operation are performed simultaneously). Moreover, in this heat-recovery-type refrigeration apparatus, the two heat-source-side heat exchangers can be individually switched between functioning as evaporators or radiators of the refrigerant, and it is possible to make a switch that causes the two heat-source-side heat exchangers to function as evaporators or radiators of the refrigerant in accordance with the overall heat load (evaporation load and/or radiation load) of the plurality of usage-side heat exchangers, taking the above-described heat recovery also into account.

SUMMARY

With such a heat-recovery-type refrigeration apparatus, during the simultaneous cooling/heating operation, when the air-cooling load is large (i.e., when the overall heat load of the usage-side heat exchangers is mainly an evaporation load), the plurality of heat-source-side heat exchangers can be caused to function as radiators of the refrigerant, and when the air-heating load is large (i.e., when the overall heat load of the usage-side heat exchangers is mainly a radiation load), the plurality of heat-source-side heat exchangers can be caused to function as evaporators of the refrigerant.

However, during the simultaneous cooling/heating operation, there are also cases in which the air-cooling load and the air-heating load are balanced (i.e., cases in which the overall heat load of the usage-side heat exchangers is small). Therefore, in such cases, reducing the overall heat load of the heat-source-side heat exchangers by causing either of the plurality of heat-source-side heat exchangers to function as an evaporator of the refrigerant, causing the other to function as a radiator of the refrigerant, and counterbalancing the evaporation load and radiation load of the plurality of heat-source-side heat exchangers, has been considered.

However, when an operation is performed that counterbalances the evaporation load and radiation load of the plurality of heat-source-side heat exchangers while the overall heat load of the usage-side heat exchangers is small, the flow rate of the refrigerant flowing through the plurality of heat-source-side heat exchangers is high, the operating capacity of the compressor must therefore be increased accordingly, and there is a tendency for operating efficiency to decrease. When there is a shift from a state in which the air-cooling load and air-heating load are balanced (i.e., a state in which the overall heat load of the usage-side heat exchangers is small) to a state in which the air-heating load is greater (i.e., a state in which the overall heat load of the usage-side heat exchangers is mainly a radiation load), it is preferable that the switch from the operation mode in which either one of the plurality of heat-source-side heat exchangers is caused to function as an evaporator of the refrigerant while the other is caused to function as a radiator of the refrigerant, to the operation mode in which the plurality of heat-source-side heat exchangers are caused to function as evaporators of the refrigerant, can be made at the appropriate timing.

An object of the present invention is to provide a heat-recovery-type refrigeration apparatus including a compressor, a plurality of heat-source-side heat exchangers, and a plurality of usage-side heat exchangers, heat recovery between the usage-side heat exchangers being possible, wherein during an operation mode in which either one of the plurality of heat-source-side heat exchangers is caused to function as a radiator of the refrigerant while the other is caused to function as an evaporator of the refrigerant, a switch to an operation mode in which the plurality of heat-source-side heat exchangers are caused to function as evaporators of the refrigerant is made at the appropriate timing.

A heat-recovery-type refrigeration apparatus according to a first aspect includes a compressor, a plurality of heat-source-side heat exchangers that can be individually switched between functioning as an evaporator or a radiator of a refrigerant, and a plurality of usage-side heat exchangers that can be individually switched between functioning as an evaporator or a radiator of the refrigerant, heat recovery between the usage-side heat exchangers being made possible by sending the refrigerant from a usage-side heat exchanger functioning as a radiator of the refrigerant to the usage-side heat exchanger functioning as an evaporator of the refrigerant. In this aspect, the refrigeration apparatus has a liquid pipe heat exchanger for performing heat exchange with the refrigerant flowing through liquid sides of the plurality of heat-source-side heat exchangers. In a first operation mode, in which either one of the plurality of heat-source-side heat exchangers is caused to function as a radiator of the refrigerant while the other is caused to function as an evaporator of the refrigerant, a first liquid pipe temperature, which is a temperature of the refrigerant on a side of the liquid pipe heat exchanger near the usage-side heat exchangers, and a second liquid pipe temperature, which is a temperature of the refrigerant on a side of the liquid pipe heat exchanger near the heat-source-side heat exchangers, are compared, and when a relationship of the first and second liquid pipe temperatures satisfies an evaporation-switch liquid pipe temperature condition, the heat-source-side heat exchanger functioning as a radiator of the refrigerant is switched to an evaporator of the refrigerant and a second operation mode is activated in which the plurality of heat-source-side heat exchangers are caused to function as evaporators of the refrigerant. These operations and controls are performed by a control part of the heat-recovery-type refrigerant apparatus.

A heat-recovery-type refrigeration apparatus according to a second aspect is the heat-recovery-type refrigeration apparatus according to the first aspect, wherein the first operation mode is maintained when the relationship of the first and second liquid pipe temperatures does not satisfy the evaporation-switch liquid pipe temperature condition.

In terms of suppressing the decrease in operating efficiency in the first operation mode during which the overall heat load of the usage-side heat exchangers is small, the switch from the first operation mode to the second operation mode during which the overall heat load of the usage-side heat exchangers is mainly the radiation load is preferably made as quickly as possible. Therefore, it is most appropriate, in terms of suppressing the decrease in operating efficiency, to make the switch from the first operation mode to the second operation mode at a timing at which the evaporation load in the heat-source-side heat exchanger functioning as an evaporator of the refrigerant exceeds the radiation load in the heat-source-side heat exchanger functioning as a radiator of the refrigerant.

Therefore, in order to make the switch from the first operation mode to the second operation mode at the appropriate timing, it is necessary to know the relationship in magnitude between the evaporation load in the heat-source-side heat exchanger functioning as an evaporator of the refrigerant and the radiation load in the heat-source-side heat exchanger functioning as a radiator of the refrigerant in the first operation mode.

In view of this, in this aspect, as described above, the liquid pipe heat exchanger is provided to perform heat exchange between the refrigerant flowing through the liquid sides of the plurality of heat-source-side heat exchangers. In the first operation mode, the first liquid pipe temperature, which is the temperature of the refrigerant on the usage-side heat exchanger-side of the liquid pipe heat exchanger, and the second liquid pipe temperature, which is the temperature of the refrigerant on the heat-source-side heat exchanger-side of the liquid pipe heat exchanger, are compared, and when the relationship of the first and second liquid pipe temperatures satisfies the evaporation-switch liquid pipe temperature condition, the mode is switched to the second operation mode. Specifically, in this aspect, whether the refrigerant passing through the liquid pipe heat exchanger is flowing from the usage-side heat exchangers to the heat-source-side heat exchangers or from the heat-source-side heat exchangers to the usage-side heat exchangers is sensed from the change in refrigerant temperature before and after the refrigerant passes through the liquid pipe heat exchanger (the first and second liquid pipe temperatures), and when the refrigerant is flowing from the usage-side heat exchangers to the heat-source-side heat exchangers (i.e., when the relationship of the first and second liquid pipe temperatures satisfies the evaporation-switch liquid pipe temperature condition), the evaporation load is judged to be greater than the radiation load in the plurality of heat-source-side heat exchangers, and the switch is made from the first operation mode to the second operation mode. Thus, the relationship in magnitude between the evaporation load in the heat-source-side heat exchanger functioning as an evaporator of the refrigerant and the radiation load in the heat-source-side heat exchanger functioning as a radiator of the refrigerant in the first operation mode is known from the change in the refrigerant temperature before and after the refrigerant passes through the liquid pipe heat exchanger (the first and second liquid pipe temperatures), and the switch is made from the first operation mode to the second operation mode.

In this aspect, during the first operation mode, in which either one of the plurality of heat-source-side heat exchangers is caused to function as a radiator of the refrigerant while the other is caused to function as an evaporator of the refrigerant, it is thereby possible for the switch to the second operation mode, in which the plurality of heat-source-side heat exchangers are caused to function as evaporators of the refrigerant, to be made at the appropriate timing. Due to the switch from the first operation mode to the second operation mode being made at the appropriate timing, the decrease in operating efficiency caused by the simultaneous cooling/heating operation mode in the first operation mode can be suppressed.

A heat-recovery-type refrigeration apparatus according to a third aspect is the heat-recovery-type refrigeration apparatus according to the first or second aspect, wherein the switch from the first operation mode to the second operation mode is made when: an evaporation-switch radiator flow rate condition is satisfied, the condition being either that a radiator flow rate, which is a flow rate of the refrigerant passing through the heat-source-side heat exchanger functioning as a radiator of the refrigerant, is equal to or less than an evaporation-switch radiator flow rate, or that a state quantity equivalent to the radiator flow rate is a value equivalent to the radiator flow rate being equal to or less than the evaporation-switch radiator flow rate; and the relationship of the first and second liquid pipe temperatures satisfies the evaporation-switch liquid pipe temperature condition.

In the first operation mode, the overall heat load of the usage-side heat exchangers is small; therefore, the flow rate of the refrigerant passing through the liquid pipe heat exchanger is low, and there is a risk of erroneous sensing or the like when the first and second liquid pipe temperatures are sensed by temperature sensors. In the event of such erroneous sensing or the like of the first and second liquid pipe temperatures, there is a risk that the relationship of the first and second liquid pipe temperatures will be erroneously determined to have satisfied the evaporation-switch liquid pipe temperature condition and there will be an erroneous switch from the first operation mode to the second operation mode.

In view of this, in this aspect, when not only does the relationship of the first and second liquid pipe temperatures satisfy the evaporation-switch liquid pipe temperature condition as described above, but the radiator flow rate (or the equivalent state quantity), which is the flow rate of the refrigerant passing through the heat-source-side heat exchanger functioning as a radiator of the refrigerant, also satisfies the evaporation-switch radiator flow rate condition, a switch is made from the first operation mode to the second operation mode. Specifically, in this aspect, when the radiator flow rate (or the equivalent state quantity) satisfies the evaporation-switch radiator flow rate condition, the radiator flow rate can be judged to be sufficiently low, and the determination that the relationship of the first and second liquid pipe temperatures satisfies the evaporation-switch liquid pipe temperature condition is therefore determined to be correct. Conversely, when the radiator flow rate (or the equivalent state quantity) does not satisfy the evaporation-switch radiator flow rate condition, the radiator flow rate can be judged to not be sufficiently low, and the determination that the relationship of the first and second liquid pipe temperatures satisfies the evaporation-switch liquid pipe temperature condition is therefore determined to be erroneous. The radiator flow rate may be calculated from the temperature and pressure of the refrigerant in the heat-source-side heat exchanger functioning as a radiator of the refrigerant, an opening degree of a heat-source-side flow rate adjusting valve, and/or other factors, and a degree of sub-cooling of the refrigerant in the outlet of the heat-source-side heat exchanger functioning as a radiator of the refrigerant, the opening degree of the heat-source-side flow rate adjusting valve, and/or other parameters may be used as the state quantity equivalent to the radiator flow rate.

In this aspect, the switch from the first operation mode to the second operation mode can thereby be made appropriately without any erroneous determinations.

A heat-recovery-type refrigeration apparatus according to a fourth aspect is any of the heat-recovery-type refrigeration apparatuses according to the first through third aspects, wherein the liquid pipe heat exchanger is a cooler for cooling the refrigerant flowing between the liquid sides of the plurality of heat-source-side heat exchangers and liquid sides of the plurality of usage-side heat exchangers, and the evaporation-switch liquid pipe temperature condition is that the first liquid pipe temperature be at least equal to or greater than the second liquid pipe temperature.

In this aspect, as described above, a cooler for cooling the refrigerant flowing between the liquid sides of the plurality of heat-source-side heat exchangers and the liquid sides of the plurality of usage-side heat exchangers is used as the liquid pipe heat exchanger. Therefore, the temperature of the refrigerant after the refrigerant has passed through the liquid pipe heat exchanger is lower than the temperature of the refrigerant before the refrigerant passes through the liquid pipe heat exchanger. Therefore, the evaporation-switch liquid pipe temperature condition is that if the first liquid pipe temperature on the side near the usage-side heat exchangers is equal to or greater than the second liquid pipe temperature on the side near the heat-source-side heat exchangers, it can be determined that the refrigerant passing through the liquid pipe heat exchanger is flowing from the side near the usage-side heat exchangers toward the side near the heat-source-side heat exchangers. The reason the phrase "at least equal to or greater than the second liquid pipe temperature" is used in this aspect is because another possible factor of the evaporation-switch liquid pipe temperature condition is that the first liquid pipe temperature be equal to or greater than a value obtained by adding a determining threshold temperature difference to the second liquid pipe temperature.

It is thereby possible in this aspect to use, as the liquid pipe heat exchanger, a cooler for cooling the refrigerant flowing between the liquid sides of the plurality of heat-source-side heat exchangers and the liquid sides of the plurality of usage-side heat exchangers, and to determine whether or not the evaporation-switch liquid pipe temperature condition is satisfied according to the temperature decrease of the refrigerant before-and-after the liquid pipe heat exchanger.

DESCRIPTION OF EMBODIMENTS

Embodiments of the heat-recovery-type refrigeration apparatus according to the present invention are described below with reference to the drawings. The specific configuration of the heat-recovery-type refrigeration apparatus according to the present invention is not limited by the embodiments and modifications thereof described below, and can be modified within a range that does not depart from the gist of the invention.

(1) Configuration of the Heat-Recovery-Type Refrigeration Apparatus (Simultaneous-Cooling/Heating-Operation-Type Air Conditioning Apparatus)

Figure 1:
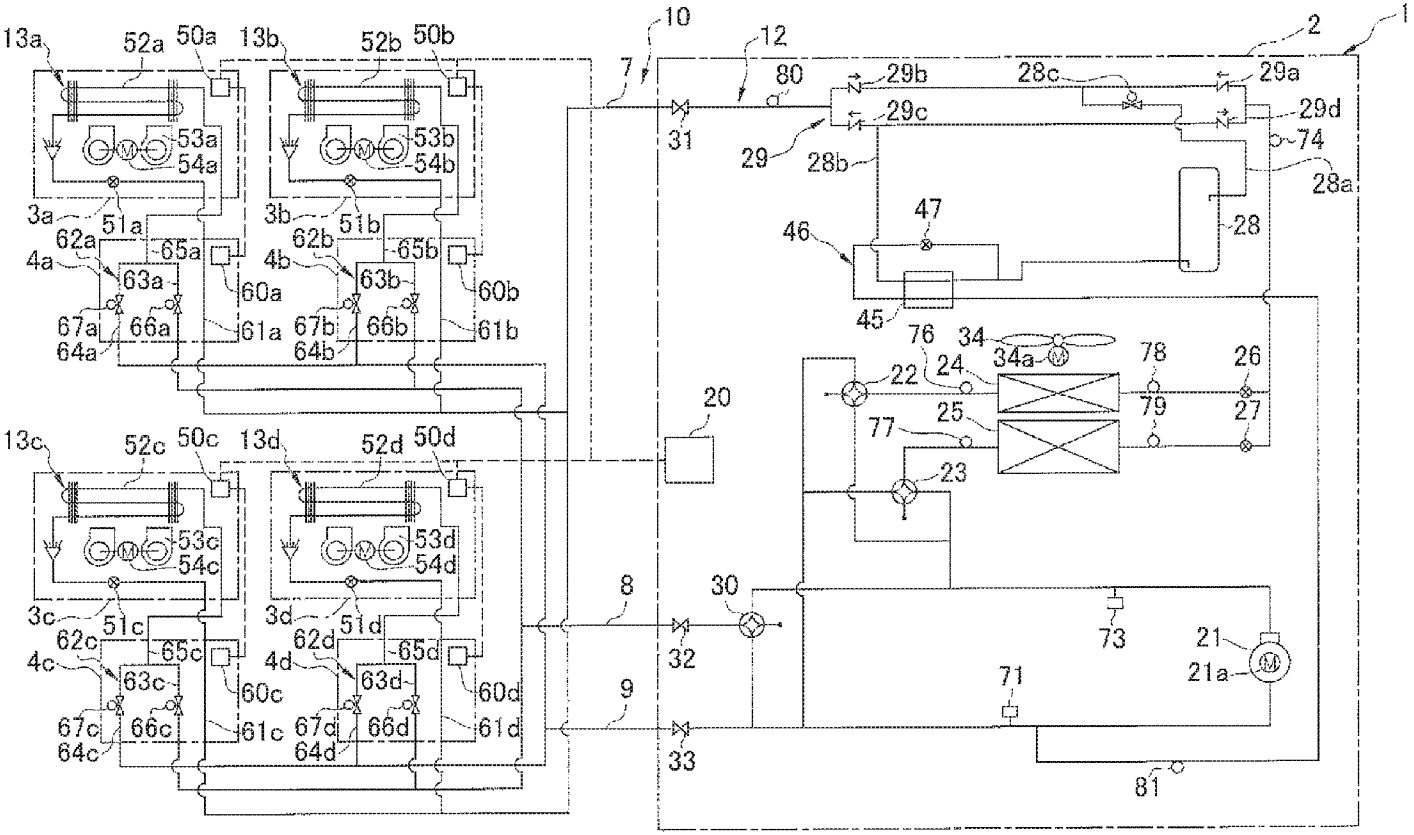
FIG. 1 is a schematic configuration diagram illustrating a simultaneous-cooling/heating-operation-type air conditioning apparatus as an embodiment of the heat-recovery-type refrigeration apparatus according to the present invention.

FIG. 1 is a schematic configuration diagram illustrating the simultaneous-cooling/heating-operation-type air conditioning apparatus 1 as an embodiment of the heat-recovery-type refrigeration apparatus according to the present invention. The simultaneous-cooling/heating-operation-type air conditioning apparatus 1 is used for indoor air cooling/heating in a building or the like by performing a vapor-compression-type refrigerating cycle.

The simultaneous-cooling/heating-operation-type air conditioning apparatus 1 has primarily a single heat-source unit 2, a plurality of (four in this case) usage units 3*a*, 3*b*, 3*c*, 3*d*, connecting units 4*a*, 4*b*, 4*c*, 4*d* connected to the usage units 3*a*, 3*b*, 3*c*, 3*d*, and refrigerant communicating pipes 7, 8, 9 for connecting the heat-source unit 2 and the usage units 3*a*, 3*b*, 3*c*, 3*d* via the connecting units 4*a*, 4*b*, 4*c*, 4*d* Specifically, a vapor-compression-type refrigerant circuit 10 of the simultaneous-cooling/heating-operation-type air conditioning apparatus 1 is configured by the connecting of the heat-source unit 2, the usage units 3*a*, 3*b*, 3*c*, 3*d*, the connecting units 4*a*, 4*b*, 4*c*, 4*d*, and the refrigerant communicating pipes 7, 8, 9. The simultaneous-cooling/heating-operation-type air conditioning apparatus 1 is also configured so that the usage units 3*a*, 3*b*, 3*c*, 3*d* can individually perform an air-cooling operation or an air-heating operation, and a refrigerant is sent from the usage unit for performing the air-heating operation to the usage unit for performing the air-cooling operation, whereby heat can be recovered between the usage units (i.e., simultaneous cooling/heating operation can be performed in which the air-cooling operation and the air-heating operation are performed simultaneously). The simultaneous-cooling/heating-operation-type air conditioning apparatus 1 is also configured so that the heat load of the heat-source unit 2 is balanced in accordance with the overall heat load of the plurality of usage units 3*a*, 3*b*, 3*c*, 3*d* taking into account the heat recovery (simultaneous cooling/heating operation) described above.

<Usage Units>

The usage units 3*a*, 3*b*, 3*c*, 3*d* are installed by being built into or suspended from an indoor ceiling of a building or the like, by hanging on the indoor wall surface, or by other means. The usage units 3*a*, 3*b*, 3*c*, 3*d* are connected to the heat-source unit 2 via the refrigerant communicating pipes 7, 8, 9 and the connecting units 4*a*, 4*b*, 4*c*, 4*d*, and constitute a portion of the refrigerant circuit 10.

The configuration of the usage units 3*a*, 3*b*, 3*c*, 3*d* will next be described. The usage unit 3*a* and the usage units 3*b*, 3*c*, 3*d* have the same configuration. Therefore, only the configuration of the usage unit 3*a* will be described. To refer to the configuration of the usage units 3*b*, 3*c*, 3*d*, the subscripts "b," "c," and "d" are added instead of "a" to the reference signs for indicating the components of the usage unit 3*a*, and the components of the usage units 3*b*, 3*c*, 3*d* will not be described.

The usage unit 3*a* primarily constitutes a portion of the refrigerant circuit 10 and has a usage-side refrigerant circuit 13*a* (usage-side refrigerant circuits 13*b*, 13*c*, 13*d* in the usage units 3*b*, 3*c*, 3*d*, respectively). The usage-side refrigerant circuit 13*a* has primarily a usage-side flow rate adjusting valve 51*a* and a usage-side heat exchanger 52*a*.

The usage-side flow rate adjusting valve 51*a* is an electric expansion valve, the opening degree of which is adjustable, connected to a liquid side of the usage-side heat exchanger 52*a* in order to perform adjustment and the like of the flow rate of the refrigerant flowing through the usage-side heat exchanger 52*a*.

The usage-side heat exchanger 52*a* is a device for exchanging heat between the refrigerant and an indoor air, and is a fin-and-tube type heat exchanger configured from a plurality of heat transfer tubes and fins, for example. Here, the usage unit 3*a* has an indoor fan 53*a* for drawing the indoor air into the unit and supplying the air indoors as a supply air after heat is exchanged, and is capable of causing heat to be exchanged between the indoor air and the refrigerant flowing through the usage-side heat exchanger 52*a*. The indoor fan 53*a* is driven by an indoor fan motor 54*a*.

The usage unit 3*a* has a usage-side control part 50*a* for controlling the operation of the components 51*a*, 54*a* constituting the usage unit 3*a* The usage-side controller 50*a* has a microcomputer and/or memory for controlling the usage unit 3*a*, and is configured so as to be capable of exchanging control signals and the like with a remote control (not shown), and exchanging control signals and the like with the heat source unit 2.

<Heat Source Unit>

The heat-source unit 2 is installed on the roof or elsewhere in a building or the like, is connected to the usage units 3*a*, 3*b*, 3*c*, 3*d* via the refrigerant communicating pipes 7, 8, 9, and constitutes the refrigerant circuit 10 with the usage units 3*a*, 3*b*, 3*c*, 3*d*.

The configuration of the heat-source unit 2 will next be described. The heat-source unit 2 primarily constitutes a portion of the refrigerant circuit 10 and has a heat-source-side refrigerant circuit 12. The heat-source-side refrigerant circuit 12 has primarily a compressor 21, a plurality of (two in this case) heat exchange switching mechanisms 22, 23, a plurality of (two in this case) heat-source-side heat exchangers 24, 25, a plurality of (two in this case) heat-source-side flow rate adjusting valves 26, 27, a receiver 28, a bridge circuit 29, a high/low pressure switching mechanism 30, a liquid-side shutoff valve 31, a high/low-pressure-gas-side shutoff valve 32, and a low-pressure-gas-side shutoff valve 33.

The compressor 21 is a device for compressing the refrigerant, and is a scroll-type or other type of positive-displacement compressor capable of varying an operating capacity by inverter control of a compressor motor 21*a*, for example.

The first heat exchange switching mechanism 22 is a four-way switching valve, for example, and is a device capable of switching a flow path of the refrigerant in the heat-source-side refrigerant circuit 12 so that a discharge side of the compressor 21 and a gas side of the first heat-source-side heat exchanger 24 are connected (as indicated by solid lines in the first heat exchange switching mechanism 22 in FIG. 1) when the first heat-source-side heat exchanger 24 is caused to function as a radiator of the refrigerant (referred to below as a "radiating operation state"), and an intake side of the compressor 21 and the gas side of the first heat-source-side heat exchanger 24 are connected (as indicated by broken lines in the first heat exchange switching mechanism 22 in FIG. 1) when the first heat-source-side heat exchanger 24 is caused to function as an evaporator of the refrigerant (referred to below as an "evaporating operation state"). The second heat exchange switching mechanism 23 is a four-way switching valve, for example, and is a device capable of switching a flow path of the refrigerant in the heat-source-side refrigerant circuit 12 so that the discharge side of the compressor 21 and a gas side of a second heat-source-side heat exchanger 25 are connected (as indicated by solid lines in the second heat exchange switching mechanism 23 in FIG. 1) when the second heat-source-side heat exchanger 25 is caused to function as a radiator of the refrigerant (referred to below as a "radiating operation state"), and the intake side of the compressor 21 and the gas side of the second heat-source-side heat exchanger 25 are connected (as indicated by broken lines in the second heat exchange switching mechanism 23 in FIG. 1) when the second heat-source-side heat exchanger 25 is caused to function as an evaporator of the refrigerant (referred to below as an "evaporating operation state"). By changing the switching states of the first heat exchange switching mechanism 22 and the second heat exchange switching mechanism 23, the first heat-source-side heat exchanger 24 and the second heat-source-side heat exchanger 25 can each individually be switched between functioning as an evaporator or a radiator of the refrigerant.

The first heat-source-side heat exchanger 24 is a device for performing heat exchange between the refrigerant and an outdoor air, and is, e.g., a fin-and-tube type heat exchanger configured from a plurality of heat transfer tubes and fins. The gas side of the first heat-source-side heat exchanger 24 is connected to the first heat exchange switching mechanism 22, and the liquid side of the first heat-source-side heat exchanger 24 is connected to the first heat-source-side flow rate adjusting valve 26. The second heat-source-side heat exchanger 25 is a device for performing heat exchange between the refrigerant and the outdoor air, and is, e.g., a fin-and-tube type heat exchanger configured from a plurality of heat transfer tubes and fins. The gas side of the second heat-source-side heat exchanger 25 is connected to the second heat exchange switching mechanism 23, and the liquid side of the second heat-source-side heat exchanger 25 is connected to the second heat-source-side flow rate adjusting valve 27. In this embodiment, the first heat-source-side heat exchanger 24 and the second heat-source-side heat exchanger 25 are configured as an integrated heat-source-side heat exchanger. The heat-source unit 2 has an outdoor fan 34 for drawing the outdoor air into the unit and discharging the air from the unit after heat is exchanged, and is capable of causing heat to be exchanged between the outdoor air and the refrigerant flowing through the heat-source-side heat exchangers 24, 25. The outdoor fan 34 is driven by a rotating speed controllable outdoor fan motor 34*a*.

The first heat-source-side flow rate adjusting valve 26 is an electric expansion valve, the opening degree of which is adjustable, connected to the liquid side of the first heat-source-side heat exchanger 24 in order to perform adjustment and the like of the flow rate of the refrigerant flowing through the first heat-source-side heat exchanger 24. The second heat-source-side flow rate adjusting valve 27 is an electric expansion valve, the opening degree of which is adjustable, connected to the liquid side of the second heat-source-side heat exchanger 25 in order to perform adjustment and the like of the flow rate of the refrigerant flowing through the second heat-source-side heat exchanger 25.

The receiver 28 is a container for temporarily storing the refrigerant flowing between the heat-source-side heat exchangers 24, 25 and the usage-side refrigerant circuits 13*a*, 13*b*, 13*c*, 13*d*. A receiver inlet pipe 28*a* is provided to an upper part of the receiver 28, and a receiver outlet pipe 28*b* is provided to a lower part of the receiver 28. A receiver inlet opening/closing valve 28*c*, the opening and closing of which can be controlled, is provided to the receiver inlet pipe 28*a*. The receiver inlet pipe 28*a* and the receiver outlet pipe 28*b* are connected between the liquid-side shutoff valve 31 and the heat-source-side heat exchangers 24, 25 via the bridge circuit 29.

The bridge circuit 29 is a circuit having a function for causing the refrigerant to flow into the receiver 28 through the receiver inlet pipe 28*a* and causing the refrigerant to flow out from the receiver 28 through the receiver outlet pipe 28*b* when the refrigerant flows toward the liquid-side shutoff valve 31 from the heat-source-side heat exchangers 24, 25, as well as when the refrigerant flows toward the heat-source-side heat exchangers 24, 25 from the liquid-side shutoff valve 31. The bridge circuit 29 has four check valves 29*a*. 29*b*, 29*c*, 29*d*. The inlet check valve 29*a* is a check valve for allowing the refrigerant to circulate only from the heat-source-side heat exchangers 24, 25 to the receiver inlet pipe 28*a*. The inlet check valve 29*b* is a check valve for allowing the refrigerant to circulate only from the liquid-side shutoff valve 31 to the receiver inlet pipe 28*a*. Specifically, the inlet check valves 29*a*, 29*b* have a function for causing the refrigerant to circulate from the heat-source-side heat exchangers 24, 25 or the liquid-side shutoff valve 31 to the receiver inlet pipe 28*a*. The outlet check valve 29*c* is a check valve for allowing the refrigerant to circulate only from the receiver outlet pipe to the liquid-side shutoff valve 31. The outlet check valve 29*d* is a check valve for allowing the refrigerant to circulate only from the receiver outlet pipe 28*b* to the heat-source-side heat exchangers 24, 25. Specifically, the outlet check valves 29*c*, 29*d* have a function for causing the refrigerant to circulate from the receiver outlet pipe 28*b* to the heat-source-side heat exchangers 24, 25 or the liquid-side shutoff valve 31.

The bridge circuit 29 is provided with a subcooling heat exchanger 45 as a liquid pipe heat exchanger for exchanging heat between the refrigerant flowing through the liquid sides of the heat-source-side heat exchangers 24, 25, and connected to the bridge circuit is an intake return pipe 46 whereby some of the refrigerant flowing between the liquid sides of the heat-source-side heat exchangers 24, 25 and the liquid sides of the usage-side heat exchangers 52*a*, 52*b*, 52*c*, 52*d* returns to the intake side of the compressor 21. The subcooling heat exchanger 45, which is provided to a receiver outlet pipe 28*b*, is a cooler that cools the refrigerant flowing through the receiver outlet pipe 28*b* (i.e., the refrigerant flowing between the liquid sides of the heat-source-side heat exchangers 24, 25 and the liquid sides of the usage-side heat exchangers 52*a*, 52*b*, 52*c*, 52*d*), using the refrigerant flowing through the intake return pipe 46 as a cooling source. The subcooling heat exchanger 45 in this embodiment is a piping heat exchanger configured by bringing the intake return pipe 46 and the receiver outlet pipe 28*b* into contact, a double-tube heat exchanger, or the like. The intake return pipe 46, which is provided so as to branch off from the receiver outlet pipe 28*b*, connects the receiver outlet pipe 28*b* and the intake side of the compressor 21 via the subcooling heat exchanger 45. An intake-return-side flow rate adjusting valve 47 is provided to the intake return pipe 46 in order to perform adjustment and the like of the flow rate of refrigerant branching off from the receiver outlet pipe 28*b*. The intake-return-side flow rate adjusting valve 47 is provided to a portion of the intake return pipe 46 that is upstream of the subcooling heat exchanger 45. The intake-return-side flow rate adjusting valve 47 in this embodiment is an electric expansion valve, the opening degree of which is adjustable.

The high/low pressure switching mechanism 30 is a four-way switching valve, for example, and is a device capable of switching the flow path of the refrigerant in the heat-source-side refrigerant circuit 12 so that the high/low-pressure-gas-side shutoff valve 32 and the discharge side of the compressor 21 are connected (as indicated by broken lines in the high/low pressure switching mechanism 30 in FIG. 1) when the high-pressure gas refrigerant discharged from the compressor 21 is sent to the usage-side refrigerant circuits 13*a*, 13*b*, 13*c*, 13*d* (referred to below as a "radiation-load operation state"), and the high/low-pressure-gas-side shutoff valve 32 and the intake side of the compressor 21 are connected (as indicated by solid lines in the high/low pressure switching mechanism 30 in FIG. 1) when the high-pressure gas refrigerant discharged from the compressor 21 is not sent to the usage-side refrigerant circuits 13*a*, 13*b*, 13*c*, 13*d* (referred to below as an "evaporation-load operation state").

The liquid-side shutoff valve 31, the high/low-pressure-gas-side shutoff valve 32, and the low-pressure-gas-side shutoff valve 33 are valves provided to a port for connection with an external device/duct (specifically, the refrigerant communicating pipes 7, 8, 9). The liquid-side shutoff valve 31 is connected to the receiver inlet pipe 28*a* or the receiver outlet pipe 28*b* via the bridge circuit 29. The high/low-pressure-gas-side shutoff valve 32 is connected to the high/low pressure switching mechanism 30. The low-pressure-gas-side shutoff valve 33 is connected to the intake side of the compressor 21.

In addition, various sensors are provided to the heat source unit 2. Specifically, the heat source unit 2 is provided with an intake pressure sensor 71 for detecting the pressure of the refrigerant in the intake side of the compressor 21, a discharge pressure sensor 73 for detecting the pressure of the refrigerant in the discharge side of the compressor 21, a second liquid pipe temperature sensor 74 for detecting the temperature of the refrigerant in the heat-source-side heat exchangers 24, 25 side of the subcooling heat exchanger 45 as a liquid pipe heat exchanger, a first gas-side temperature sensor 76 for detecting the temperature of the refrigerant in the gas side of the first heat-source-side heat exchanger 24, a second gas-side temperature sensor 77 for detecting the temperature of the refrigerant in the gas side of the second heat-source-side heat exchanger 25, a first liquid-side temperature sensor 78 for detecting the temperature of the refrigerant in the liquid side of the first heat-source-side heat exchanger 24, a second liquid-side temperature sensor 79 for detecting the temperature of the refrigerant in the liquid side of the second heat-source-side heat exchanger 25, a first liquid pipe temperature sensor 80 for detecting the temperature of the refrigerant in the usage-side heat exchangers 52*a*, 52*b*, 52*c*, 52*d*-side of the subcooling heat exchanger 45 as a liquid pipe heat exchanger, and an intake-return-side temperature sensor 81 for detecting the temperature of the refrigerant flowing through the intake return pipe 46. The heat-source unit 2 has a heat-source-side control part 20 for controlling the operation of the components 21*a*, 22, 23, 26, 27, 28*c*, 30, 34*a* constituting the heat-source unit 2. The heat-source-side control part 20 has a microcomputer and memory provided for controlling the heat source unit 2, and is able to exchange control signals and the like with usage-side control parts 50*a*, 50*b*, 50*c*, 50*d* of the usage units 3*a*, 3*b*, 3*c*, 3*d*.

<Connecting Units>

The connecting units 4*a*, 4*b*, 4*c*, 4*d* are provided together with the usage units 3*a*, 3*b*, 3*c*, 3*d* inside a building or the like. The connecting units 4*a*, 4*b*, 4*c*, 4*d* are interposed between usage units 3*a*, 3*b*, 3*c*, 3*d* and the heat-source unit 2 together with the refrigerant communicating pipes 7, 8, 9, and constitute a portion of the refrigerant circuit 10.

The configuration of the connecting units 4*a*, 4*b*, 4*c*, 4*d* will next be described. The connecting unit 4*a* and the connecting units 4*b*, 4*c*, 4*d* have the same configuration. Therefore, only the configuration of the connecting unit 4*a* will be described. To refer to the configuration of the connecting units 4*b*, 4*c*, 4*d*, the subscripts "b," "c," and "d" are added instead of "a" to the reference signs for indicating the components of the connecting unit 4*a*, and the components of the connecting units 4*b*, 4*c*, 4*d* will not be described.

The connecting unit 4*a* primarily constitutes a portion of the refrigerant circuit 10 and has a connection-side refrigerant circuit 14*a* (connection-side refrigerant circuit 14*b*, 14*c*, 14*d* in the connecting units 4*b*, 4*c*, 4*d*, respectively). The connection-side refrigerant circuit 14*a* has primarily a liquid connecting pipe 61*a* and a gas connecting pipe 62*a*.

The liquid connecting pipe 61*a* connects the liquid refrigerant communicating pipe 7 and the usage-side flow rate adjusting valve 51*a* of the usage-side refrigerant circuit 13*a*.

The gas connecting pipe 62*a* has a high-pressure gas connecting pipe 63*a* connected to the high/low-pressure gas refrigerant communicating pipe 8, a low-pressure gas connecting pipe 64*a* connected to the low-pressure gas refrigerant communicating pipe 9, and a merging gas connecting pipe 65*a* for merging the high-pressure gas connecting pipe 63*a* and the low-pressure gas connecting pipe 64*a*. The merging gas connecting pipe 65*a* is connected to the gas side of the usage-side heat exchanger 52*a* of the usage-side refrigerant circuit 13*a*. A high-pressure gas opening/closing valve 66*a*, the opening and closing of which can be controlled, is provided to the high-pressure gas connecting pipe 63*a*, and a low-pressure gas opening/closing valve 67*a*, the opening and closing of which can be controlled, is provided to the low-pressure gas connecting pipe 64*a*.

During the air-cooling operation by the usage unit 3*a*, the connecting unit 4*a* can function so that the low-pressure gas opening/closing valve 67*a* is placed in an open state, the refrigerant flowing into the liquid connecting pipe 61*a* through the liquid refrigerant communicating pipe 7 is sent to the usage-side heat exchanger 52*a* through the usage-side flow rate adjusting valve 51*a* of the usage-side refrigerant circuit 13*a*, and the refrigerant evaporated by heat exchange with the indoor air in the usage-side heat exchanger 52*a* is returned to the low-pressure gas refrigerant communicating pipe 9 through the merging gas connecting pipe 65*a* and the low-pressure gas connecting pipe 64*a*. During the air-heating operation by the usage unit 3*a*, the connecting unit 4*a* can function so that the low-pressure gas opening/closing valve 67*a* is closed and the high-pressure gas opening/closing valve 66*a* is placed in an open state, the refrigerant flowing into the high-pressure gas connecting pipe 63*a* and the merging gas connecting pipe 65*a* through the high/low-pressure gas refrigerant communicating pipe 8 is sent to the usage-side heat exchanger 52*a* of the usage-side refrigerant circuit 13*a*, and the refrigerant radiated by heat exchange with the indoor air in the usage-side heat exchanger 52*a* is returned to the liquid refrigerant communicating pipe 7 through the usage-side flow rate adjusting valve 51*a* and the liquid connecting pipe 61*a*. This function is performed not only by the connecting unit 4*a*, but also by the connecting units 4*b*, 4*c*, 4*d* in the same manner, and the usage-side heat exchangers 52*a*, 52*b*, 52*c*, 52*d* can therefore each individually be switched between functioning as evaporators or radiators of the refrigerant by the connecting units 4*a*, 4*b*, 4*c*, 4*d*.

The connecting unit 4*a* has a connection-side control part 60*a* for controlling the operation of the components 66*a*, 67*a* constituting the connecting unit 4*a*. The connection-side control part 60*a* has a microcomputer and/or memory provided to control the connecting unit 4*a*, and is configured so as to be capable of exchanging control signals and the like with the usage-side control unit 50*a* of the usage unit 3*a*.

The usage-side refrigerant circuits 13*a*, 13*b*, 13*c*. 13*d*, the heat-source-side refrigerant circuit 12, the refrigerant communication pipes 7, 8, 9, and the connection-side refrigerant circuits 14*a*, 14*b*, 14*c*, 14*d* are connected as described above to configure the refrigerant circuit 10 of the simultaneous-cooling/heating-operation-type air conditioning apparatus 1. The simultaneous-cooling/heating-operation-type air conditioning apparatus 1 is also configured so as to be capable of simultaneous cooling/heating operation in which the usage units 3*c*, 3*d* perform the air-heating operation while the usage units 3*a*, 3*b* perform the air-cooling operation, for example. At this time, the refrigerant is sent from the usage-side heat exchangers 52*a*, 52*b* functioning as radiators of the refrigerant to the usage-side heat exchangers 52*c*, 52*d* functioning as evaporators of the refrigerant, whereby heat is recovered between the usage units 3*a*, 3*b*, 3*c*, 3*d*. Specifically, the simultaneous-cooling/heating-operation-type air conditioning apparatus 1, which includes the compressor 21, the plurality of (two in this case) heat-source-side heat exchangers 24, 25 capable of individually switching between functioning as evaporators or radiators of the refrigerant, and the plurality of (four in this case) usage-side heat exchangers 52*a*, 52*b*, 52*c*, 52*d* capable of individually switching between functioning as evaporators or radiators of the refrigerant, constitutes a heat-recovery-type refrigeration apparatus capable of recovering heat between usage-side heat exchangers by sending the refrigerant from a usage-side heat exchanger functioning as a radiator of the refrigerant to a usage-side heat exchanger functioning as an evaporator of the refrigerant. The simultaneous-cooling/heating-operation-type air conditioning apparatus 1 also has the subcooling heat exchanger 45 as a liquid pipe heat exchanger for exchanging heat between the refrigerant flowing through the liquid sides of the plurality of heat-source-side heat exchangers 24, 25.

(2) Operation of the Heat-Recovery-Type Refrigeration Apparatus (Simultaneous-Cooling/Heating-Operation-Type Air Conditioning Apparatus)

The operation of the simultaneous-cooling/heating-operation-type air conditioning apparatus 1 will next be described.

The operation modes of the simultaneous-cooling/heating-operation-type air conditioning apparatus 1 can be divided into an air-cooling operation mode, an air-heating operation mode, a simultaneous cooling/heating operation mode (mainly evaporation load), a simultaneous cooling/heating operation mode (mainly radiation load) as a second operation mode, and a simultaneous cooling/heating operation mode (balanced evaporation and radiation load) as a first operation mode. In this embodiment, the air-cooling operation 30) mode is an operation mode in which only usage units performing the air-cooling operation (i.e., operation in which the usage-side heat exchanger functions as an evaporator of the refrigerant) are present, and the heat-source-side heat exchangers 24, 25 are caused to function as radiators of the refrigerant for the overall evaporation load of the usage units. The air-heating operation mode is an operation mode in which only usage units performing the air-heating operation (i.e., operation in which the usage-side heat exchanger functions as a radiator of the refrigerant) are present, and the heat-source-side heat exchangers 24, 25 are caused to function as evaporators of the refrigerant for the overall radiation load of the usage units. The simultaneous cooling/heating operation mode (mainly evaporation load) is an operation mode in which only the first heat-source-side heat exchanger 24 is caused to function as a radiator of the refrigerant for the overall evaporation load of the usage units when there is a mixture of usage units performing the air-cooling operation (i.e., operation in which the usage-side heat exchanger functions as an evaporator of the refrigerant) and usage units performing the air-heating operation (i.e., operation in which the usage-side heat exchanger functions as a radiator of the refrigerant), and the overall heat load of the usage units is mainly an evaporation load. The simultaneous cooling/heating operation mode (mainly radiation load) is an operation mode in which only the first heat-source-side heat exchanger 24 is caused to function as an evaporator of the refrigerant for the overall radiation load of the usage units when there is a mixture of usage units performing the air-cooling operation (i.e., operation in which the usage-side heat exchanger functions as an evaporator of the refrigerant) and usage units performing the air-heating operation (i.e., operation in which the usage-side heat exchanger functions as a radiator of the refrigerant), and the overall heat load of the usage units is mainly a radiation load. The simultaneous cooling/heating operation mode (balanced evaporation and radiation load) is an operation mode in which the first heat-source-side heat exchanger 24 is caused to function as a radiator of the refrigerant and the second heat-source-side heat exchanger 25 is caused to function as an evaporator of the refrigerant when there is a mixture of usage units performing the air-cooling operation (i.e., operation in which the usage-side heat exchanger functions as an evaporator of the refrigerant) and usage units performing the air-heating operation (i.e., operation in which the usage-side heat exchanger functions as a radiator of the refrigerant), and the evaporation load and radiation load of the usage units overall are balanced.

The operation of the simultaneous-cooling/heating-operation-type air conditioning apparatus 1 including these operation modes is performed by the control parts 20, 50*a*, 50*b*, 50*c*, 50*d*, 60*a*, 60*b*, 60*c*, 60*d* described above.

<Air-Cooling Operation Mode>

Figure 2:
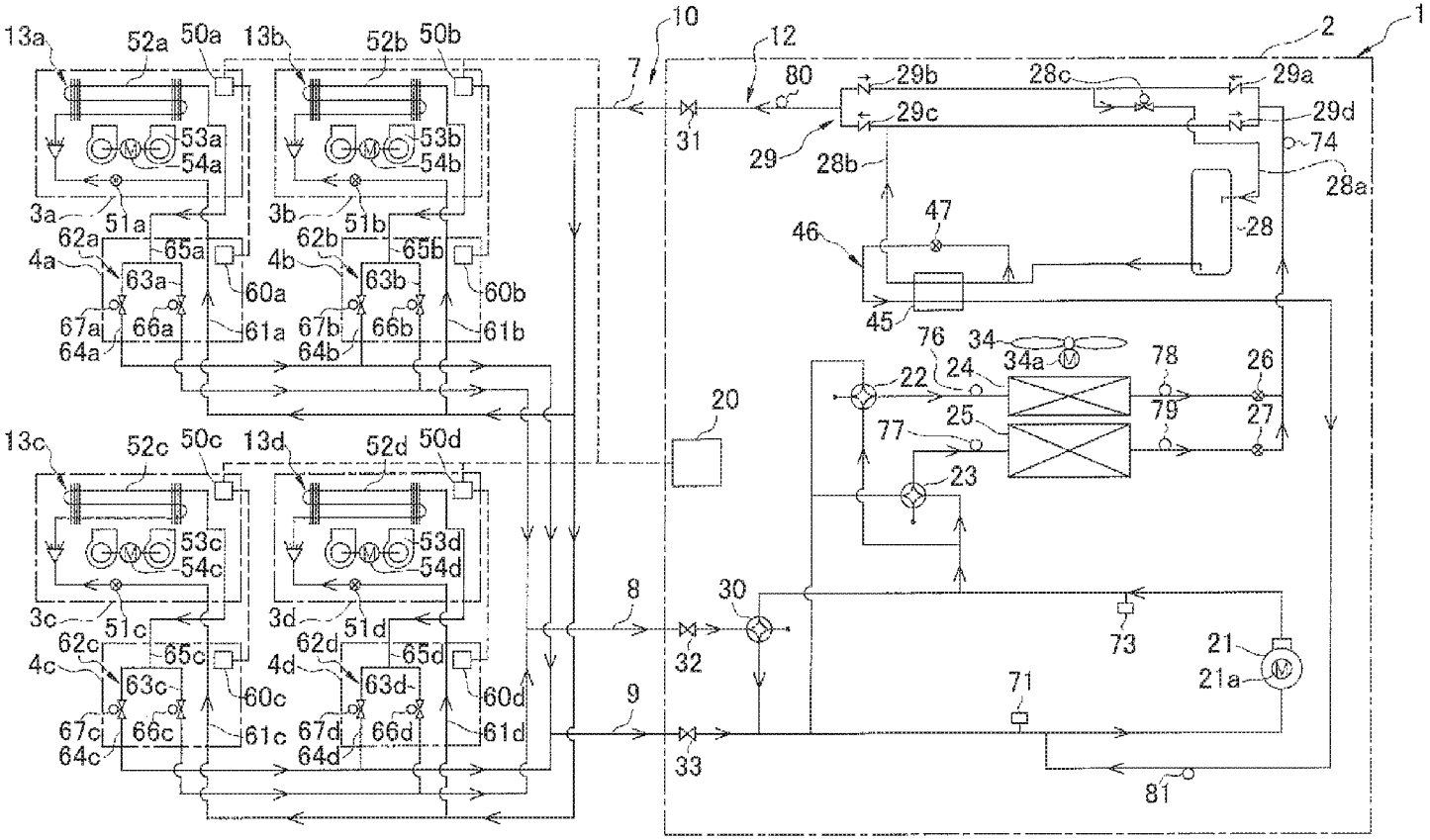
FIG. 2 is a view illustrating operation (refrigerant flow) in an air-cooling operation mode of the simultaneous-cooling/heating-operation-type air conditioning apparatus.

In the air-cooling operation mode e.g., when all of the usage units 3*a*, 3*b*, 3*c*, 3*d* are performing the air-cooling operation (i.e., operation in which all of the usage-side heat exchangers 52*a*, 52*b*, 52*c*, 52*d* function as evaporators of the refrigerant) and both of the heat-source-side heat exchangers 24, 25 function as radiators of the refrigerant, the refrigerant circuit 10 of the air conditioning apparatus 1 is configured as illustrated in FIG. 2 (see the flow of the refrigerant being illustrated by arrows drawn in the refrigerant circuit 10 in FIG. 2).

Specifically, in the heat-source unit 2, the first heat exchange switching mechanism 22 is switched to the radiating operation state (state indicated by solid lines in the first heat exchange switching mechanism 22 in FIG. 2) and the second heat exchange switching mechanism 23 is switched to the radiating operation state (state indicated by solid lines in the second heat exchange switching mechanism 23 in FIG. 2), whereby both of the heat-source-side heat exchangers 24, 25 are caused to function as radiators of the refrigerant. The high/low pressure switching mechanism 30 is also switched to the evaporation-load operation state (state indicated by solid lines in the high/low pressure switching mechanism 30 in FIG. 2) The opening degrees of the heat-source-side flow rate adjusting valves 26, 27 are also adjusted, and the receiver inlet opening/closing valve 28*c* is open. Furthermore, the opening degree of the intake-return-side flow rate adjusting valve 47 is adjusted, and the subcooling heat exchanger 45 functions as a cooler of the refrigerant flowing through the receiver outlet pipe 28*b*. In the connecting units 4*a*, 4*b*, 4*c*, 4*d*, the high-pressure gas opening/closing valves 66*a*, 66*b*, 66*c*, 66*d* and the low-pressure gas opening/closing valves 67*a*, 67*b*, 67*c*, 67*d* are placed in the open state, whereby all of the usage-side heat exchangers 52*a*, 52*b*, 52*c*, 52*d* of the usage units 3*a*, 3*b*, 3*c*, 3*d* are caused to function as evaporators of the refrigerant, and all of the usage-side heat exchangers 52*a*, 52*b*, 52*c*, 52*d* of the usage units 3*a*, 3*b*, 3*c*, 3*d* and the intake side of the compressor 21 of the heat-source unit 2 are connected via the high/low-pressure gas refrigerant communicating pipe 8 and the low-pressure gas refrigerant communicating pipe 9. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, high-pressure gas refrigerant compressed and discharged by the compressor 21 is sent to both of the heat-source-side heat exchangers 24, 25 through the heat exchange switching mechanisms 22, 23. The high-pressure gas refrigerant sent to the heat-source-side heat exchangers 24, 25 is then radiated in the heat-source-side heat exchangers 24, 25 by heat exchange with the outdoor air supplied as a heat source by the outdoor fan 34. After the flow rate of the refrigerant radiated in the heat-source-side heat exchangers 24, 25 is adjusted in the heat-source-side flow rate adjusting valves 26, 27, the refrigerant is merged and sent to the receiver 28 through the inlet check valve 29*a* and the receiver inlet opening/closing valve 28*c*. After the refrigerant sent to the receiver 28 has been temporarily stored in the receiver 28, some of the refrigerant is branched to the intake return pipe 46, and is then sent to the subcooling heat exchanger 45. The refrigerant sent to the subcooling heat exchanger 45 and flowing through the receiver outlet pipe 28*b* is cooled by the refrigerant of which the flow rate has been adjusted in the intake-return-side flow rate adjusting valve 47 of the intake return pipe 46. The refrigerant cooled in the subcooling heat exchanger 45 and flowing through the receiver outlet pipe 28*b* is sent through the outlet check valve 29*c* and the liquid-side shutoff valve 31 to the liquid refrigerant communicating pipe 7.

The refrigerant sent to the liquid refrigerant communicating pipe 7 is branched into four streams and sent to the liquid connecting pipes 61*a*, 61*b*, 61*c*, 61*d* of the connecting units 4*a*, 4*b*, 4*c*, 4*d*. The refrigerant sent to the liquid connecting pipes 61*a*, 61*b*, 61*c*, 61*d* is then sent to the usage-side flow rate adjusting valves 51*a*, 51*b*, 51*c*, 51*d* of the usage units 3*a*, 3*b*, 3*c*, 3*d*.

After the flow rate of the refrigerant sent to the usage-side flow rate adjusting valves 51*a*, 51*b*, 51*c*, 51*d* is adjusted in the usage-side flow rate adjusting valves 51*a*, 51*b*, 51*c*, 51*d*, the refrigerant is evaporated in the usage-side heat exchangers 52*a*, 52*b*, 52*c*, 52*d* by heat exchange with the indoor air supplied by the indoor fans 53*a*, 53*b*, 53*c*, 53*d*, and becomes the low-pressure gas refrigerant. Meanwhile, the indoor air is cooled and supplied the indoors, and the air-cooling operation by the usage units 3*a*, 3*b*, 3*c*, 3*d* is performed. The low-pressure gas refrigerant is then sent to the merging gas connecting pipes 65*a*, 65*b*, 65*c*, 65*d* of the connecting units 4*a*, 4*b*, 4*c*, 4*d*.

The low-pressure gas refrigerant sent to the merging gas connecting pipes 65*a*, 65*b*, 65*c*, 65*d* is then sent to the high/low-pressure gas refrigerant communicating pipe 8 through the high-pressure gas opening/closing valves 66*a*, 66*b*, 66*c*, 66*d* and the high-pressure gas connecting pipes 63*a*, 63*b*, 63*c*, 63*d* and merged, and also sent to the low-pressure gas refrigerant communicating pipe 9 through the low-pressure gas opening/closing valves 67*a*, 67*b*, 67*c*, 67*d* and the low-pressure gas connecting pipes 64*a*, 64*b*, 64*c*, 64*d* and merged.

The low-pressure gas refrigerant sent to the gas refrigerant communicating pipes 8, 9 is then returned to the intake side of the compressor 21 through the gas-side shutoff valves 32, 33 and the high/low pressure switching mechanism 30.

Operation is carried out in this manner in the air-cooling operation mode.

<Air-Heating Operation Mode>

Figure 3:
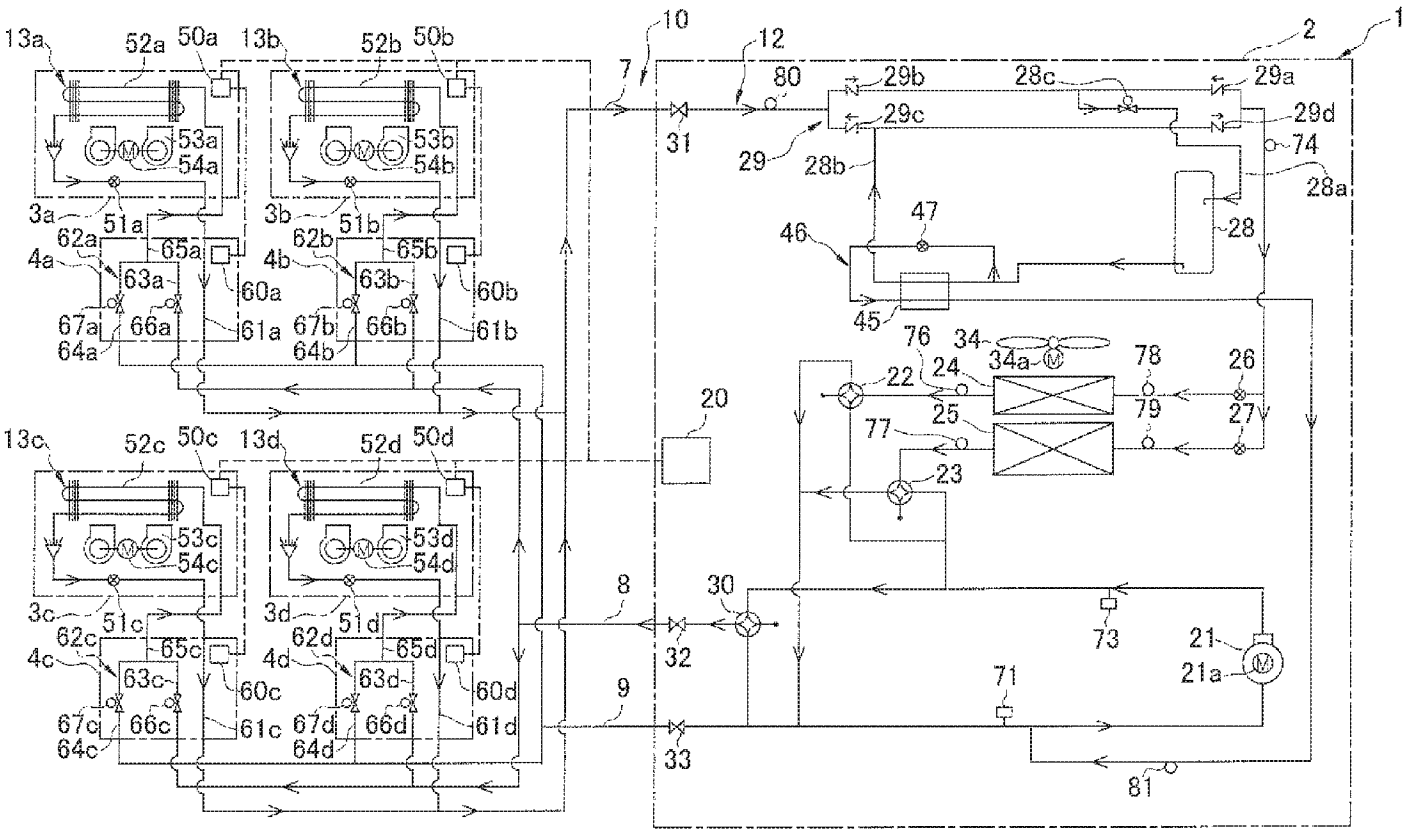
FIG. 3 is a view illustrating operation (refrigerant flow) in an air-heating operation mode of the simultaneous-cooling/heating-operation-type air conditioning apparatus.

In the air-heating operation mode, e.g., when all of the usage units 3*a*, 3*b*, 3*c*, 3*d* are performing the air-heating operation (i.e., operation in which all of the usage-side heat exchangers 52*a*, 52*b*, 52*c*, 52*d* function as radiators of the refrigerant) and both of the heat-source-side heat exchangers 24, 25 function as evaporators of the refrigerant, the refrigerant circuit 10 of the air conditioning apparatus 1 is configured as illustrated in FIG. 3 (see the flow of the refrigerant being illustrated by arrows drawn in the refrigerant circuit 10 in FIG. 3).

Specifically, in the heat-source unit 2, the first heat exchange switching mechanism 22 is switched to the evaporating operation state (state indicated by broken lines in the first heat exchange switching mechanism 22 in FIG. 3) and the second heat exchange switching mechanism 23 is switched to the evaporating operation state (state indicated by broken lines in the second heat exchange switching mechanism 23 in FIG. 3), whereby both of the heat-source-side heat exchangers 24, 25 are caused to function as evaporators of the refrigerant. The high/low pressure switching mechanism 30 is also switched to the radiation-load operation state (state indicated by broken lines in the high/low pressure switching mechanism 30 in FIG. 3). The opening degrees of the heat-source-side flow rate adjusting valves 26, 27 are also adjusted, and the receiver inlet opening/closing valve 28*c* is open. Furthermore, the opening degree of the intake-return-side flow rate adjusting valve 47 is adjusted, and the subcooling heat exchanger 45 functions as a cooler of the refrigerant flowing through the receiver outlet pipe 28*b*. In the connecting units 4*a*, 4*b*, 4*c*, 4*d*, the high-pressure gas opening/closing valves 66*a*, 66*b*, 66*c*, 66*d* are placed in the open state and the low-pressure gas opening/closing valves 67*a*, 67*b*, 67*c*, 67*d* are placed in the closed state, whereby all of the usage-side heat exchangers 52*a*, 52*b*, 52*c*, 52*d* of the usage units 3*a*, 3*b*, 3*c*, 3*d* are caused to function as radiators of the refrigerant, and all of the usage-side heat exchangers 52*a*, 52*b*, 52*c*, 52*d* of the usage units 3*a*, 3*b*, 3*c*, 3*d* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32.

The high-pressure gas refrigerant sent to the high/low-pressure gas refrigerant communicating pipe 8 is branched into four streams and sent to the high-pressure gas connecting pipes 63*a*, 63*b*, 63*c*, 63*d* of the connecting units 4*a*, 4*b*, 4*c*, 4*d*. The high-pressure gas refrigerant sent to the high-pressure gas connecting pipes 63*a*, 63*b*, 63*c*, 63*d* is then sent to the usage-side heat exchangers 52*a*, 52*b*, 52*c*, 52*d* of the usage units 3*a*, 3*b*, 3*c*, 3*d* through the high-pressure gas opening/closing valves 66*a*, 66*b*, 66*c*, 66*d* and the merging gas connecting pipes 65*a*, 65*b*, 65*c*, 65*d*.

The high-pressure gas refrigerant sent to the usage-side heat exchangers 52*a*, 52*b*, 52*c*, 52*d* is then radiated in the usage-side heat exchangers 52*a*, 52*b*, 52*c*, 52*d* by heat exchange with the indoor air supplied by the indoor fans 53*a*, 53*b*, 53*c*, 53*d*. Meanwhile, the indoor air is heated and supplied the indoors, and the air-heating operation by the usage units 3*a*, 3*b*, 3*c*, 3*d* is performed. After the flow rate of the refrigerant radiated in the usage-side heat exchangers 52*a*, 52*b*, 52*c*, 52*d* is adjusted in the usage-side flow rate adjusting valves 51*a*, 51*b*, 51*c*, 51*d*, the refrigerant is sent to the liquid connecting pipes 61*a*, 61*b*, 61*c*, 61*d* of the connecting units 4*a*, 4*b*, 4*c*, 4*d*.

The refrigerant sent to the liquid connecting pipes 61*a*, 61*b*, 61*c*, 61*d* is then sent to the liquid refrigerant communicating pipe 7 and merged.

The refrigerant sent to the liquid refrigerant communicating pipe 7 is then sent to the receiver 28 through the liquid-side shutoff valve 31, the inlet check valve 29*b*, and the receiver inlet opening/closing valve 28*c*. After the refrigerant sent to the receiver 28 has been temporarily stored in the receiver 28, some of the refrigerant is branched to the intake return pipe 46, and is then sent to the subcooling heat exchanger 45. The refrigerant sent to the subcooling heat exchanger 45 and flowing through the receiver outlet pipe 28*b* is cooled by the refrigerant of which the flow rate has been adjusted in the intake-return-side flow rate adjusting valve 47 of the intake return pipe 46. The refrigerant cooled in the subcooling heat exchanger 45 and flowing through the receiver outlet pipe 28*b* is sent through the outlet check valve 29*d* to both of the heat-source-side flow rate adjusting valves 26, 27. After the flow rate of the refrigerant sent to the heat-source-side flow rate adjusting valves 26, 27 is adjusted in the heat-source-side flow rate adjusting valves 26, 27, the refrigerant is evaporated in the heat-source-side heat exchangers 24, 25 by heat exchange with the outdoor air supplied by the outdoor fan 34, and becomes the low-pressure gas refrigerant, and is sent to the heat exchange switching mechanisms 22, 23. The low-pressure gas refrigerant sent to the heat exchange switching mechanisms 22, 23 is merged and returned to the intake side of the compressor 21.

Operation is carried out in this manner in the air-heating operation mode.

<Simultaneous Cooling/Heating Operation Mode (Mainly Evaporation Load)>

Figure 4:
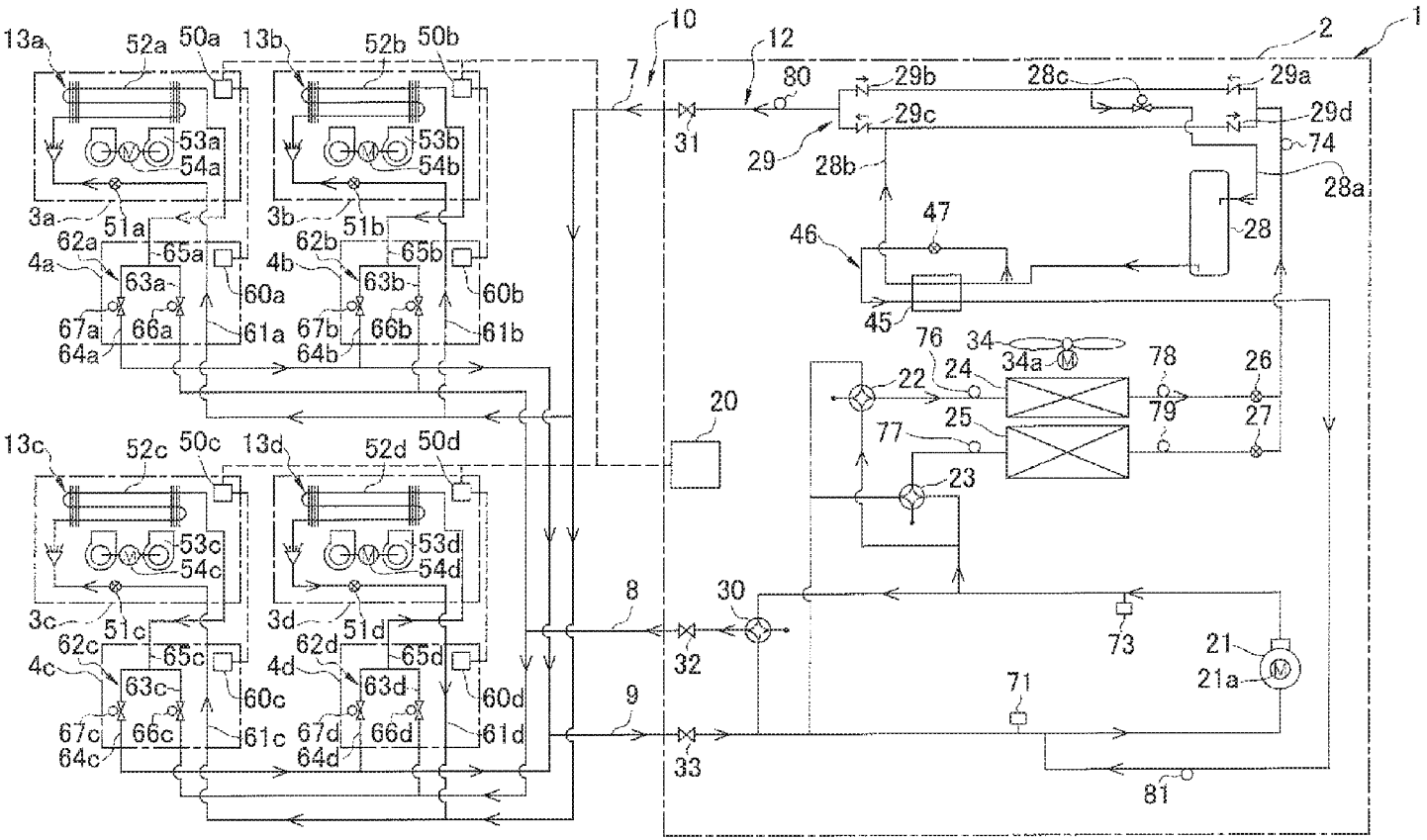
FIG. 4 is a view illustrating operation (refrigerant flow) in a simultaneous cooling/heating operation mode (mainly evaporation load) of the simultaneous-cooling/heating-operation-type air conditioning apparatus.

In the simultaneous cooling/heating operation mode (mainly evaporation load), e.g., when the usage units 3*a*, 3*b*, 3*c* are performing the air-cooling operation and the usage unit 3*d* is performing the air-heating operation (i.e., operation in which the usage-side heat exchangers 52*a*, 52*b*, 52*c* function as evaporators of the refrigerant and the usage-side heat exchanger 52*d* functions as a radiator of the refrigerant) and only the first heat-source-side heat exchanger 24 functions as a radiator of the refrigerant, the refrigerant circuit 10 of the air conditioning apparatus 1 is configured as illustrated in FIG. 4 (see the flow of the refrigerant being illustrated by arrows drawn in the refrigerant circuit 10 in FIG. 4).

Specifically, in the heat-source unit 2, the first heat exchange switching mechanism 22 is switched to the radiating operation state (state indicated by solid lines in the first heat exchange switching mechanism 22 in FIG. 4), whereby only the first heat-source-side heat exchanger 24 is caused to function as a radiator of the refrigerant. The high/low pressure switching mechanism 30 is also switched to the radiation-load operation state (state indicated by broken lines in the high/low pressure switching mechanism 30) in FIG. 4). The opening degree of the first heat-source-side flow rate adjusting valve 26 is also adjusted, the second heat-source-side flow rate adjusting valve 27 is closed, and the receiver inlet opening/closing valve 28*c* is open. Furthermore, the opening degree of the intake-return-side flow rate adjusting valve 47 is adjusted, and the subcooling heat exchanger 45 functions as a cooler of the refrigerant flowing through the receiver outlet pipe 28*b*. In the connecting units 4*a*, 4*b*, 4*c*, 4*d*, the high-pressure gas opening/closing valve 66*d* and the low-pressure gas opening/closing valves 67*a*, 67*b*, 67*c* are placed in the open state and the high-pressure gas opening/closing valves 66*a*, 66*b*, 66*c* and the low-pressure gas opening/closing valve 67*d* are placed in the closed state, whereby the usage-side heat exchangers 52*a*, 52*b*, 52*c* of the usage units 3*a*, 3*b*, 3*c* are caused to function as evaporators of the refrigerant, the usage-side heat exchanger 52*d* of the usage unit 3*d* is caused to function as a radiator of the refrigerant, the usage-side heat exchangers 52*a*, 52*b*, 52*c* of the usage units 3*a*, 3*b*, 3*c* and the intake side of the compressor 21 of the heat-source unit 2 are connected via the low-pressure gas refrigerant communicating pipe 9), and the usage-side heat exchanger 52*d* of the usage unit 3*d* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, a portion of the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32, and the remainder thereof is sent to the first heat-source-side heat exchanger 24 through the first heat exchange switching mechanism 22.

The high-pressure gas refrigerant sent to the high/low-pressure gas refrigerant communicating pipe 8 is sent to the high-pressure gas connecting pipe 63*d* of the connecting unit 4*d*. The high-pressure gas refrigerant sent to the high-pressure gas connecting pipe 63*d* is sent to the usage-side heat exchanger 52*d* of the usage unit 3*d* through the high-pressure gas opening/closing valve 66*d* and the merging gas connecting pipe 65*d*.

The high-pressure gas refrigerant sent to the usage-side heat exchanger 52*d* is then radiated in the usage-side heat exchanger 52*d* by heat exchange with the indoor air supplied by the indoor fan 53*d*. Meanwhile, the indoor air is heated and supplied the indoors, and the air-heating operation by the usage unit 3*d* is performed. After the flow rate of the refrigerant radiated in the usage-side heat exchanger 52*d* is adjusted in the usage-side flow rate adjusting valve 51*d*, the refrigerant is sent to the liquid connecting pipe 61*d* of the connecting unit 4*d*.

The high-pressure gas refrigerant sent to the first heat-source-side heat exchanger 24 is also radiated in the first heat-source-side heat exchanger 24 by heat exchange with the outdoor air supplied as a heat source by the outdoor fan 34. After the flow rate of the refrigerant radiated in the first heat-source-side heat exchanger 24 is adjusted in the first heat-source-side flow rate adjusting valve 26, the refrigerant is sent to the receiver 28 through the inlet check valve 29*a* and the receiver inlet opening/closing valve 28*c*. After the refrigerant sent to the receiver 28 has been temporarily stored in the receiver 28, some of the refrigerant is branched to the intake return pipe 46, and is then sent to the subcooling heat exchanger 45. The refrigerant sent to the subcooling heat exchanger 45 and flowing through the receiver outlet pipe 28*b* is cooled by the refrigerant of which the flow rate has been adjusted in the intake-return-side flow rate adjusting valve 47 of the intake return pipe 46. The refrigerant cooled in the subcooling heat exchanger 45 and flowing through the receiver outlet pipe 28*b* is sent through the outlet check valve 29*c* and the liquid-side shutoff valve 31 to the liquid refrigerant communicating pipe 7.

The refrigerant radiated in the usage-side heat exchanger 52*d* and sent to the liquid connecting pipe 61*d* is then sent to the liquid refrigerant communicating pipe 7, and merged with the refrigerant radiated in the first heat-source-side heat exchanger 24 and sent to the liquid refrigerant communicating pipe 7.

The refrigerant merged in the liquid refrigerant communicating pipe 7 is then branched into three streams and sent to the liquid connecting pipes 61*a*, 61*b*, 61*c* of the connecting units 4*a*, 4*b*, 4*c* The refrigerant sent to the liquid connecting pipes 61*a*, 61*b*, 61*c* is then sent to the usage-side flow rate adjusting valves 51*a*, 51*b*, 51*c* of the usage units 3*a*, 3*b*, 3*c*.

After the flow rate of the refrigerant sent to the usage-side flow rate adjusting valves 51*a*, 51*b*, 51*c* is adjusted in the usage-side flow rate adjusting valves 51*a*, 51*b*, 51*c*, the refrigerant is evaporated in the usage-side heat exchangers 52*a*, 52*b*, 52*c* by heat exchange with the indoor air supplied by the indoor fans 53*a*, 53*b*, 53*c*, and becomes the low-pressure gas refrigerant. Meanwhile, the indoor air is cooled and supplied the indoors, and the air-cooling operation by the usage units 3*a*, 3*b*, 3*c* is performed. The low-pressure gas refrigerant is then sent to the merging gas connecting pipes 65*a*, 65*b*, 65*c* of the connecting units 4*a*, 4*b*, 4*c*.

The low-pressure gas refrigerant sent to the merging gas connecting pipes 65*a*, 65*b*, 65*c* is then sent to the low-pressure gas refrigerant communicating pipe 9 through the low-pressure gas opening/closing valves 67*a*, 67*b*, 67*c* and the low-pressure gas connecting pipes 64*a*, 64*b*, 64*c* and merged.

The low-pressure gas refrigerant sent to the low-pressure gas refrigerant communicating pipe 9 is then returned to the intake side of the compressor 21 through the low-pressure-gas-side shutoff valve 33.

Operation in the simultaneous cooling/heating operation mode (mainly evaporation load) is performed in the manner described above. In the simultaneous cooling/heating operation mode (mainly evaporation load), the refrigerant is sent from the usage-side heat exchanger 52*d* functioning as a radiator of the refrigerant to the usage-side heat exchangers 52*a*, 52*b*, 52*c* functioning as evaporators of the refrigerant, as described above, whereby heat is recovered between the usage-side heat exchangers 52*a*, 52*b*, 52*c*, 52*d*.

<Simultaneous Cooling/Heating Operation Mode (Mainly Radiation Load)>

Figure 5:
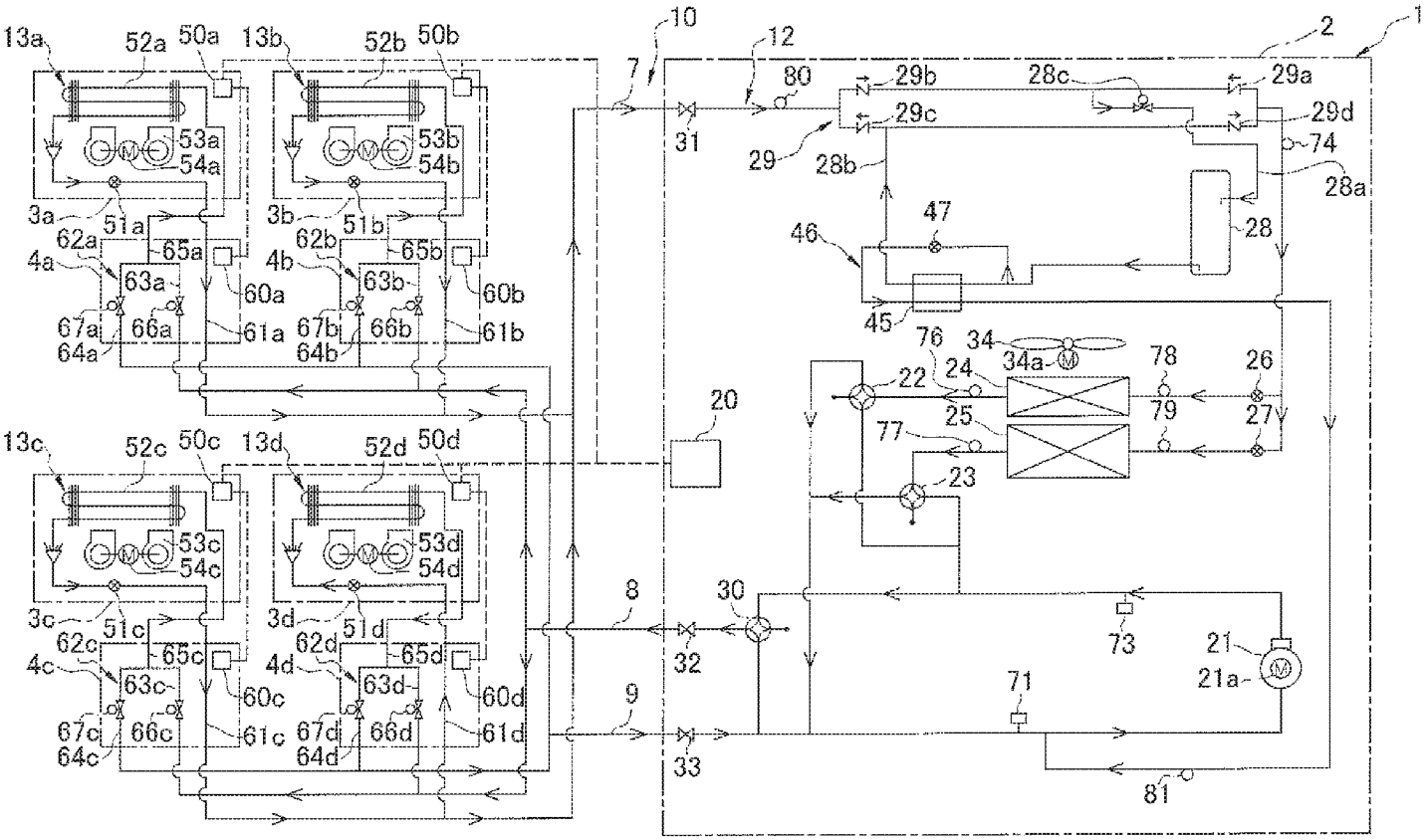
FIG. 5 is a view illustrating operation (refrigerant flow) in a simultaneous cooling/heating operation mode (mainly radiation load) of the simultaneous-cooling/heating-operation-type air conditioning apparatus.

In the simultaneous cooling/heating operation mode (mainly radiation load) as a second operation mode, e.g., when the usage units 3*a*, 3*b*, 3*c* are performing the air-heating operation and the usage unit 3*d* is performing the air-cooling operation (i.e., operation in which the usage-side heat exchangers 52*a*, 52*b*, 52*c* function as radiators of the refrigerant and the usage-side heat exchanger 52*d* functions as an evaporator of the refrigerant), and the heat-source-side heat exchanger 24, 25 functions as evaporators of the refrigerant, the refrigerant circuit 10 of the air conditioning apparatus 1 is configured as illustrated in FIG. 5 (see the flow of the refrigerant being illustrated by arrows drawn in the refrigerant circuit 10 in FIG. 5).

Specifically, in the heat-source unit 2, the first heat exchange switching mechanism 22 is switched to the evaporating operation state (state indicated by broken lines in the first heat exchange switching mechanism 22 in FIG. 5) and the second heat exchange switching mechanism 23 is switched to the evaporating operation state (state indicated by broken lines in the second heat exchange switching mechanism 23 in FIG. 5), whereby the heat-source-side heat exchangers 24, 25 are caused to function as evaporators of the refrigerant. The high/low pressure switching mechanism 30 is also switched to the radiation-load operation state (state indicated by broken lines in the high/low pressure switching mechanism 30 in FIG. 5). The opening degree of the first heat-source-side flow rate adjusting valve 26 is also adjusted, the second heat-source-side flow rate adjusting valve 27 is closed, and the receiver inlet opening/closing valve 28*c* is open. Furthermore, the opening degree of the intake-return-side flow rate adjusting valve 47 is adjusted, and the subcooling heat exchanger 45 functions as a cooler of the refrigerant flowing through the receiver outlet pipe 28*b*. In the connecting units 4*a*, 4*b*, 4*c*, 4*d*, the high-pressure gas opening/closing valves 66*a*, 66*b*, 66*c* and the low-pressure gas opening/closing valve 67*d* are placed in the open state and the high-pressure gas opening/closing valve 66*d* and the low-pressure gas opening/closing valves 67*a*, 67*b*, 67*c* are placed in the closed state, whereby the usage-side heat exchangers 52*a*, 52*b*, 52*c* of the usage units 3*a*, 3*b*, 3*c* are caused to function as radiators of the refrigerant, the usage-side heat exchanger 52*d* of the usage unit 3*d* is caused to function as an evaporator of the refrigerant, the usage-side heat exchanger 52*d* of the usage unit 3*d* and the intake side of the compressor 21 of the heat-source unit 2 are connected via the low-pressure gas refrigerant communicating pipe 9, and the usage-side heat exchangers 52*a*, 52*b*, 52*c* of the usage units 3*a*, 3*b*, 3*c* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32.

The high-pressure gas refrigerant sent to the high/low-pressure gas refrigerant communicating pipe 8 is then branched into three streams and sent to the high-pressure gas connecting pipes 63*a*, 63*b*, 63*c* of the connecting units 4*a*, 4*b*, 4*c*. The high-pressure gas refrigerant sent to the high-pressure gas connecting pipes 63*a*, 63*b*, 63*c* is sent to the usage-side heat exchangers 52*a*, 52*b*, 52*c* of the usage units 3*a*, 3*b*, 3*c* through the high-pressure gas opening/closing valves 66*a*, 66*b*, 66*c* and the merging gas connecting pipes 65*a*, 65*b*, 65*c*.

The high-pressure gas refrigerant sent to the usage-side heat exchangers 52*a*, 52*b*, 52*c* is then radiated in the usage-side heat exchangers 52*a*, 52*b*, 52*c* by heat exchange with the indoor air supplied by the indoor fans 53*a*, 53*b*, 53*c*. Meanwhile, the indoor air is heated and supplied the indoors, and the air-heating operation by the usage units 3*a*, 3*b*, 3*c* is performed. After the flow rate of the refrigerant radiated in the usage-side heat exchangers 52*a*, 52*b*, 52*c* is adjusted in the usage-side flow rate adjusting valves 51*a*, 51*b*, 51*c*, the refrigerant is sent to the liquid connecting pipes 61*a*, 61*b*, 61*c* of the connecting units 4*a*, 4*b*, 4*c*.

The refrigerant sent to the liquid connecting pipes 61*a*, 61*b*, 61*c*, 61*d* is then sent to the liquid refrigerant communicating pipe 7 and merged.

A portion of the refrigerant merged in the liquid refrigerant communicating pipe 7 is sent to the liquid connecting pipe 61*d* of the connecting unit 4*d*, and the remainder thereof is sent to the receiver 28 through the liquid-side shutoff valve 31, the inlet check valve 29*b*, and the receiver inlet opening/closing valve 28*c*.

The refrigerant sent to the liquid connecting pipe 61*d* of the connecting unit 4*d* is then sent to the usage-side flow rate adjusting valve 51*d* of the usage unit 3*d*.

After the flow rate of the refrigerant sent to the usage-side flow rate adjusting valve 51*d* is adjusted in the usage-side flow rate adjusting valve 51*d*, the refrigerant is evaporated in the usage-side heat exchanger 52*d* by heat exchange with the indoor air supplied by the indoor fan 53*d*, and becomes the low-pressure gas refrigerant. Meanwhile, the indoor air is cooled and supplied the indoors, and the air-cooling operation by the usage unit 3*d* is performed. The low-pressure gas refrigerant is then sent to the merging gas connecting pipe 65*d* of the connecting unit 4*d*.

The low-pressure gas refrigerant sent to the merging gas connecting pipe 65*d* is then sent to the low-pressure gas refrigerant communicating pipe 9 through the low-pressure gas opening/closing valve 67*d* and the low-pressure gas connecting pipe 64*d*.

The low-pressure gas refrigerant sent to the low-pressure gas refrigerant communicating pipe 9 is then returned to the intake side of the compressor 21 through the low-pressure-gas-side shutoff valve 33.

After the refrigerant sent to the receiver 28 has been temporarily stored in the receiver 28, some of the refrigerant is branched to the intake return pipe 46, and is then sent to the subcooling heat exchanger 45. The refrigerant sent to the subcooling heat exchanger 45 and flowing through the receiver outlet pipe 28*b* is cooled by the refrigerant of which the flow rate has been adjusted in the intake-return-side flow rate adjusting valve 47 of the intake return pipe 46. The refrigerant cooled in the subcooling heat exchanger 45 and flowing through the receiver outlet pipe 28*b* is sent through the outlet check valve 29*d* to both of the heat-source-side flow rate adjusting valves 26, 27. After the flow rate of the refrigerant sent to the heat-source-side flow rate adjusting valves 26, 27 is adjusted in the heat-source-side flow rate adjusting valves 26, 27, the refrigerant is evaporated in the heat-source-side heat exchangers 24, 25 by heat exchange with the outdoor air supplied by the outdoor fan 34, and becomes the low-pressure gas refrigerant, and is sent to the heat exchange switching mechanisms 22, 23. The low-pressure gas refrigerant sent to the heat exchange switching mechanisms 22, 23 is then merged with the low-pressure gas refrigerant returned to the intake side of the compressor 21 through the low-pressure gas refrigerant communicating pipe 9 and the low-pressure-gas-side shutoff valve 33, and is returned to the intake side of the compressor 21.

Operation is carried out in this manner in the simultaneous cooling/heating operation mode (mainly radiation load) as a second operation mode. In the simultaneous cooling/heating operation mode (mainly radiation load), the refrigerant is sent from the usage-side heat exchangers 52*a*, 52*b*, 52*c* functioning as radiators of the refrigerant to the usage-side heat exchanger 52*d* functioning as an evaporator of the refrigerant, as described above, whereby heat is recovered between the usage-side heat exchangers 52*a*, 52*b*, 52*c*, 52*d*.

<Simultaneous Cooling/Heating Operation Mode (Balanced Evaporation and Radiation Load)>

Figure 6:
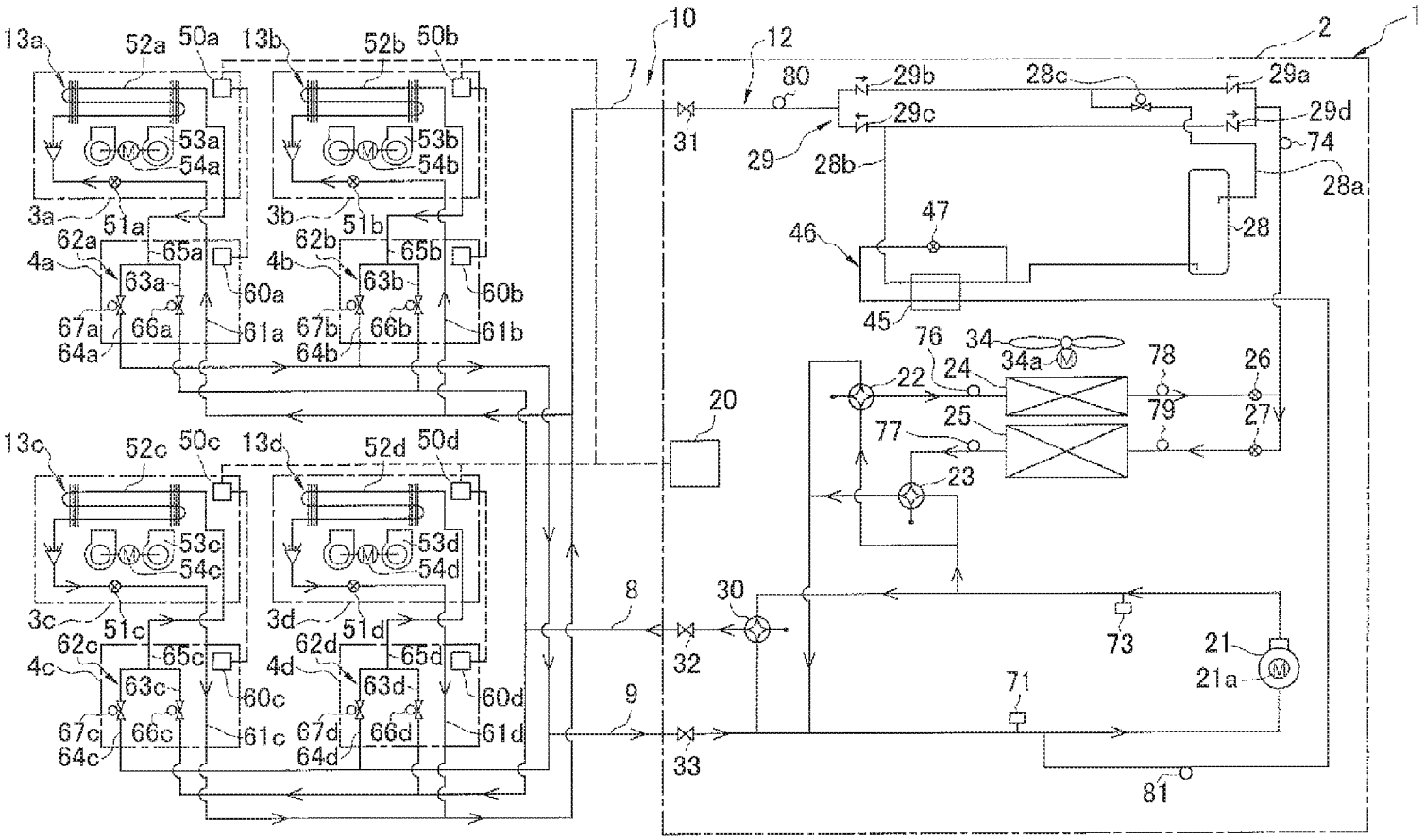
FIG. 6 is a view illustrating operation (refrigerant flow) in a simultaneous cooling/heating operation mode (balanced evaporation and radiation load) of the simultaneous-cooling/heating-operation-type air conditioning apparatus.

In the simultaneous cooling/heating operation mode (balanced evaporation and radiation load) as a first operation mode, e.g., when the usage units 3*a*, 3*b* are performing the air-cooling operation and the usage units 3*c*, 3*d* are performing the air-heating operation (i.e., operation in which the usage-side heat exchangers 52*a*, 52*b* function as evaporators of the refrigerant and the usage-side heat exchangers 52*c*, 52*d* function as radiators of the refrigerant), the first heat-source-side heat exchanger 24 functions as a radiator of the refrigerant, and the second heat-source-side heat exchanger 25 functions as an evaporator of the refrigerant, the refrigerant circuit 10 of the air conditioning apparatus 1 is configured as illustrated in FIG. 6 (see the flow of the refrigerant being illustrated by arrows drawn in the refrigerant circuit 10 in FIG. 6).

Specifically, in the heat-source unit 2, the first heat exchange switching mechanism 22 is switched to the radiating operation state (state indicated by solid lines in the first heat exchange switching mechanism 22 in FIG. 6) and the second heat exchange switching mechanism 23 is switched to the evaporating operation state (state indicated by broken lines in the second heat exchange switching mechanism 23 in FIG. 6), whereby the first heat-source-side heat exchanger 24 is caused to function as a radiator of the refrigerant and the second heat-source-side heat exchanger 25 is caused to function as an evaporator of the refrigerant. The high/low pressure switching mechanism 30 is also switched to a radiation-load operation state (state indicated by broken lines in the high/low pressure switching mechanism 30 in FIG. 6). The opening degrees of the heat-source-side flow rate adjusting valves 26, 27 are also adjusted, and the receiver inlet opening/closing valve 28*c* is open. Furthermore, the opening degree of the intake-return-side flow rate adjusting valve 47 is adjusted, and the subcooling heat exchanger 45 functions as a cooler of the refrigerant flowing through the receiver outlet pipe 28*b*. In the connecting units 4*a*, 4*b*, 4*c*, 4*d*, the high-pressure gas opening/closing valves 66*c*, 66*d* and the low-pressure gas opening/closing valves 67*a*, 67*b* are placed in the open state, and the high-pressure gas opening/closing valves 66*a*, 66*b* and the low-pressure gas opening/closing valves 67*c*, 67*d* are placed in the closed state, whereby the usage-side heat exchangers 52*a*, 52*b* of the usage units 3*a*, 3*b* are caused to function as evaporators of the refrigerant, the usage-side heat exchangers 52*c*, 52*d* of the usage units 3*c*, 3*d* are caused to function as radiators of the refrigerant, the usage-side heat exchangers 52*a*, 52*b* of the usage units 3*a*, 3*b* and the intake side of the compressor 21 of the heat-source unit 2 are connected via the low-pressure gas refrigerant communicating pipe 9, and the usage-side heat exchangers 52*c*, 52*d* of the usage units 3*c*, 3*d* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, a portion of the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32, and the remainder thereof is sent to the first heat-source-side heat exchanger 24 through the first heat exchange switching mechanism 22.

The high-pressure gas refrigerant sent to the high/low-pressure gas refrigerant communicating pipe 8 is then sent to the high-pressure gas connecting pipes 63*c*, 63*d* of the connecting units 4*c*, 4*d*. The high-pressure gas refrigerant sent to the high-pressure gas connecting pipes 63*c*, 63*d* is sent to the usage-side heat exchangers 52*c*, 52*d* of the usage units 3*c*, 3*d* through the high-pressure gas opening/closing valves 66*c*, 66*d* and the merging gas connecting pipes 65*c*, 65*d*.

The high-pressure gas refrigerant sent to the usage-side heat exchangers 52*c*, 52*d* is then radiated in the usage-side heat exchangers 52*c*, 52*d* by heat exchange with the indoor air supplied by the indoor fans 53*c*, 53*d*. Meanwhile, the indoor air is heated and supplied the indoors, and the air-heating operation by the usage units 3*c*, 3*d* is performed. After the flow rate of the refrigerant radiated in the usage-side heat exchangers 52*c*, 52*d* is adjusted in the usage-side flow rate adjusting valves 51*c*, 51*d*, the refrigerant is sent to the liquid connecting pipes 61*c*, 61*d* of the connecting units 4*c*, 4*d*.

The refrigerant radiated in the usage-side heat exchangers 52*c*, 52*d* and sent to the liquid connecting pipes 61*c*, 61*d* is then sent to the liquid refrigerant communicating pipe 7 and merged.

The refrigerant merged in the liquid refrigerant communicating pipe 7 is then branched into two streams and sent to the liquid connecting pipes 61*a*, 61*b* of the connecting units 4*a*, 4*b*. The refrigerant sent to the liquid connecting pipes 61*a*, 61*b* is then sent to the usage-side flow rate adjusting valves 51*a*, 51*b* of the usage units 3*a*, 3*b*.

After the flow rate of the refrigerant sent to the usage-side flow rate adjusting valves 51*a*, 51*b* is adjusted in the usage-side flow rate adjusting valves 51*a*, 51*b*, the refrigerant is evaporated in the usage-side heat exchangers 52*a*, 52*b* by heat exchange with the indoor air supplied by the indoor fans 53*a*, 53*b*, and becomes the low-pressure gas refrigerant. Meanwhile, the indoor air is cooled and supplied the indoors, and the air-cooling operation by the usage units 3*a*, 3*b* is performed. The low-pressure gas refrigerant is then sent to the merging gas connecting pipes 65*a*, 65*b* of the connecting units 4*a*, 4*b*.

The low-pressure gas refrigerant sent to the merging gas connecting pipes 65*a*, 65*b* is then sent to the low-pressure gas refrigerant communicating pipe 9 through the low-pressure gas opening/closing valves 67*a*, 67*b* and the low-pressure gas connecting pipes 64*a*, 64*b* and merged.

The low-pressure gas refrigerant sent to the low-pressure gas refrigerant communicating pipe 9 is then returned to the intake side of the compressor 21 through the low-pressure-gas-side shutoff valve 33.

The high-pressure gas refrigerant sent to the first heat-source-side heat exchanger 24 is also radiated in the first heat-source-side heat exchanger 24 by heat exchange with the outdoor air supplied as a heat source by the outdoor fan 34. The refrigerant radiated in the first heat-source-side heat exchanger 24 then passes through the first heat-source-side flow rate adjusting valve 26, after which almost all thereof is sent to the second heat-source-side flow rate adjusting valve 27. Therefore, the refrigerant radiated in the first heat-source-side heat exchanger 24 is not sent to the liquid refrigerant communicating pipe 7 through the receiver 28, the bridge circuit 29, and the liquid-side shutoff valve 31. After the flow rate of the refrigerant sent to the second heat-source-side flow rate adjusting valve 27 is adjusted in the second heat-source-side flow rate adjusting valve 27, the refrigerant is evaporated in the second heat-source-side heat exchanger 25 by heat exchange with the outdoor air supplied by the outdoor fan 34, becomes the low-pressure gas refrigerant, and is sent to the second heat exchange switching mechanism 23. The low-pressure gas refrigerant sent to the second heat exchange switching mechanism 23 is then merged with the low-pressure gas refrigerant returned to the intake side of the compressor 21 through the low-pressure gas refrigerant communicating pipe 9 and the gas-side shutoff valve 33, and is returned to the intake side of the compressor 21.

Operation is carried out in this manner in the simultaneous cooling/heating operation mode (balanced evaporation and radiation load) as a first operation mode. In the simultaneous cooling/heating operation mode (balanced evaporation and radiation load), the refrigerant is sent from the usage-side heat exchangers 52*c*, 52*d* functioning as radiators of the refrigerant to the usage-side heat exchangers 52*a*, 52*b* functioning as evaporators of the refrigerant, as described above, whereby heat is recovered between the usage-side heat exchangers 52*a*, 52*b*, 52*c*, 52*d*.

Moreover, in the simultaneous cooling/heating operation mode (balanced evaporation and radiation load), the first heat-source-side heat exchanger 24 is caused to function as a radiator of the refrigerant and the second heat-source-side heat exchanger 25 is caused to function as an evaporator of the refrigerant, as described above, whereby a countermeasure is performed that causes the evaporation load and the radiation load of the heat-source-side heat exchangers 24, 25 to counterbalance each other. In this embodiment, a state is assumed in which the overall head load of the usage-side heat exchangers 52*a*, 52*b*, 52*c*, 52*d* is lessened by heat recovery between the usage-side heat exchangers 52*a*, 52*b*, 52*c*, 52*d*, and the radiation load of the first heat-source-side heat exchanger 24 and the evaporation load of the second heat-source-side heat exchanger 25 perfectly counterbalance each other; therefore, a state arises in which there is no refrigerant flow between the usage units 3*a*, 3*b*, 3*c*, 3*d* and the heat source unit 2 via the liquid refrigerant communicating pipe 7, as shown in FIG. 6.

However, when, e.g., the state changes from that of FIG. 6 towards a state in which the evaporation load of the usage-side heat exchangers 52*a*, 52*b* functioning as evaporators of the refrigerant is greater than the radiation load of the usage-side heat exchangers 52*c*, 52*d* functioning as radiators of the refrigerant, the refrigerant must be sent from the heat source unit 2 to the usage units 3*a*, 3*b*, 3*c*, 3*d* via the liquid refrigerant communicating pipe 7. Therefore, in this case, the state changes from one in which the radiation load of the first heat-source-side heat exchanger 24 and the evaporation load of the second heat-source-side heat exchanger 25 perfectly counterbalance each other, to one in which the radiation load of the first heat-source-side heat exchanger 24 exceeds the evaporation load of the second heat-source-side heat exchanger 25, and the resulting state is one in which the refrigerant flows from the heat-source-side heat exchanger-24-side toward the usage-side heat exchanger-52*a*, 52*b*, 52*c*, 52*d*-side (see FIG. 7). Moreover, when, e.g., the state changes from that of FIG. 6 toward one in which the radiation load of the usage-side heat exchangers 52*c*, 52*d* functioning as radiators of the refrigerant is greater than the evaporation load of the usage-side heat exchangers 52*a*, 52*b* functioning as evaporators of the refrigerant, the refrigerant must be sent from the usage units 3*a*, 3*b*, 3*c*, 3*d* to the heat source unit 2 via the liquid refrigerant communicating pipe 7. Therefore, in this case, the state changes from one in which the radiation load of the first heat-source-side heat exchanger 24 and the evaporation load of the second heat-source-side heat exchanger 25 perfectly counterbalance each other, to one in which the evaporation load of the second heat-source-side heat exchanger 25 exceeds the radiation load of the first heat-source-side heat exchanger 24, and the resulting state is one in which the refrigerant flows from the usage-side heat exchanger-52*a*, 52*b*, 52*c*, 52*d*-side toward the heat-source-side heat exchanger-24-side (see FIG. 8).

Figure 7:
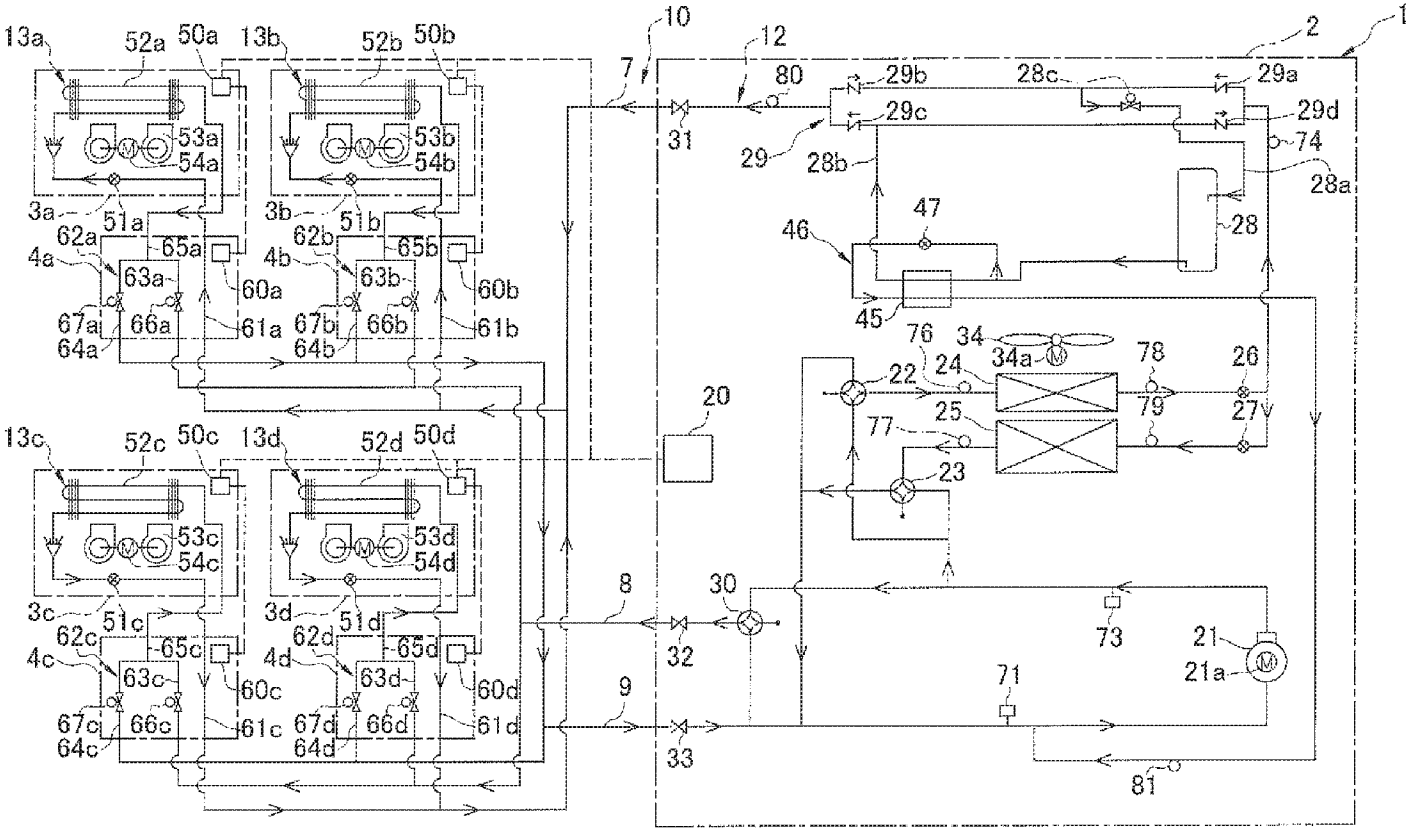
FIG. 7 is a view illustrating operation (refrigerant flow) in a simultaneous cooling/heating operation mode (balanced evaporation and radiation load) of the simultaneous-cooling/heating-operation-type air conditioning apparatus.
Figure 8:
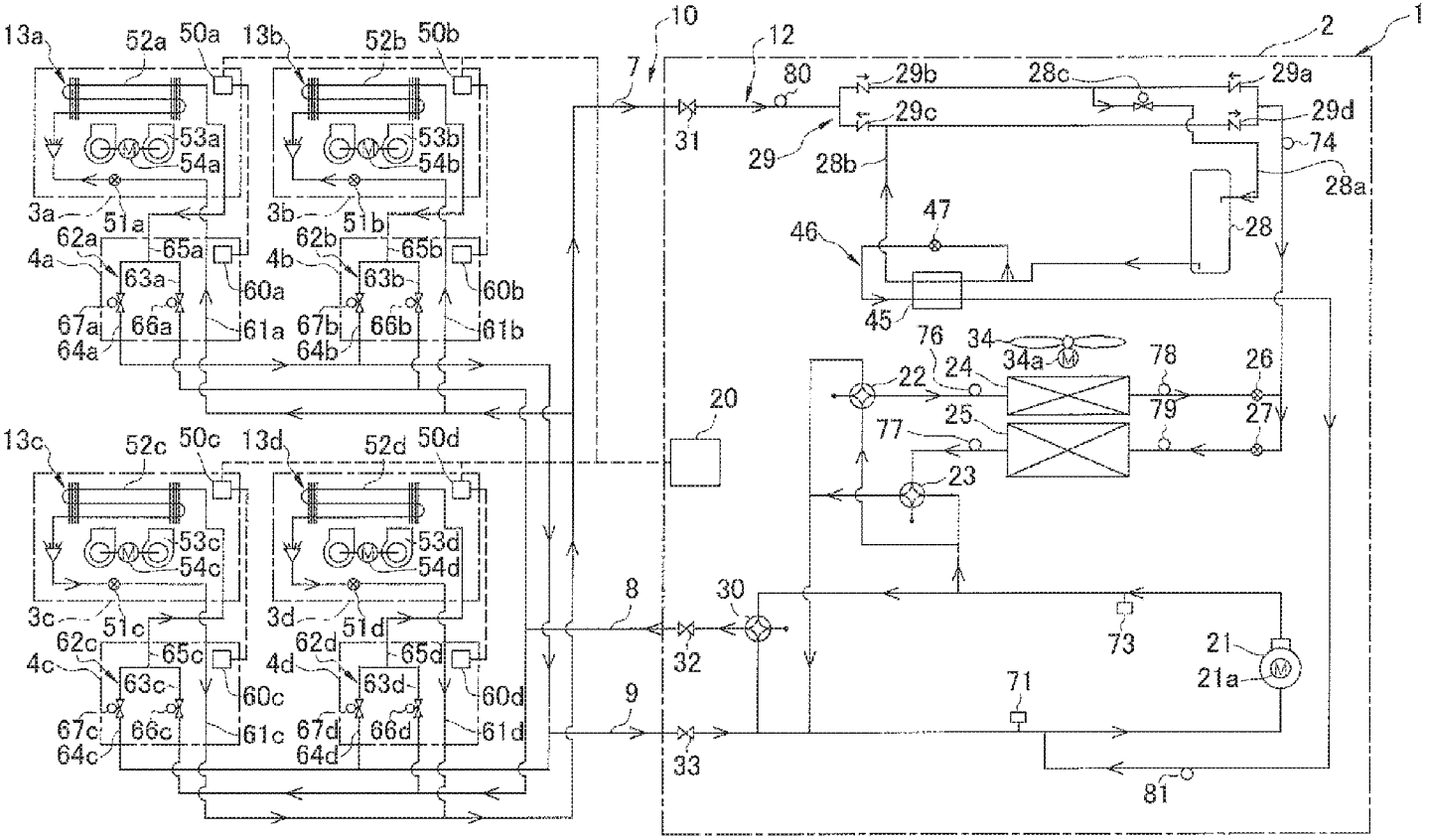
FIG. 8 is a view illustrating operation (refrigerant flow) in a simultaneous cooling/heating operation mode (balanced evaporation and radiation load) of the simultaneous-cooling/heating-operation-type air conditioning apparatus.

Thus, the simultaneous cooling/heating operation mode (balanced evaporation and radiation load) not only includes a state in which the overall heat load of the usage-side heat exchangers 52*a*, 52*b*, 52*c*, 52*d* is lessened and the radiation load of the first heat-source-side heat exchanger 24 and the evaporation load of the second heat-source-side heat exchanger 25 perfectly counterbalance each other, such as in the state of FIG. 6, but also includes a state in which the radiation load of the first heat-source-side heat exchanger 24 exceeds the evaporation load of the second heat-source-side heat exchanger 25, and a state in which the evaporation load of the second heat-source-side heat exchanger 25 exceeds the radiation load of the first heat-source-side heat exchanger 24, such as the states of FIGS. 7 and 8.

(3) Switch from First Operation Mode to Second Operation Mode

As described above, during the simultaneous cooling/heating operation mode (balanced evaporation and radiation load) as a first operation mode, i.e. when an operation is performed that counterbalances the evaporation load and the radiation load of the heat-source-side heat exchangers 24, 25 in the case of a small overall heat load of the usage-side heat exchangers 52*a*, 52*b*, 52*c*, 52*d*, the flow rate of the refrigerant flowing through the heat-source-side heat exchangers 24, 25 becomes greater, the operating capacity of the compressor 21 must therefore be increased accordingly, and there is a tendency for operating efficiency to decrease. When there is a shift from a state in which the air-cooling load and the air-heating load are balanced (i.e., a state in which the overall heat load of the usage-side heat exchangers 52*a*, 52*b*, 52*c*, 52*d* is small) to a state in which the air-heating load is greater (a state in which the overall heat load of the usage-side heat exchangers 52*a*, 52*b*, 52*c*, 52*d* is mainly a radiation load), it is preferable that the switch from simultaneous cooling/heating operation mode (balanced evaporation and radiation load), in which either one of the heat-source-side heat exchangers 24, 25 (the second heat-source-side heat exchanger 25 in this case) is caused to function as an evaporator of the refrigerant while the other (the first heat-source-side heat exchanger 24 in this case) is caused to function as a radiator of the refrigerant, to simultaneous cooling/heating operation mode (mainly radiation load) as a second operation mode, in which the heat-source-side heat exchangers 24, 25 are caused to function as evaporators of the refrigerant, can be made at the appropriate timing.

In terms of suppressing the decrease in operating efficiency in the simultaneous cooling/heating operation mode (balanced evaporation and radiation load) during which the overall heat load of the usage-side heat exchangers 52*a*, 52*b*, 52*c*, 52*d* is small, the switch from the simultaneous cooling/heating operation mode (balanced evaporation and radiation load) to the simultaneous cooling/heating operation mode (mainly radiation load) during which the overall heat load of the usage-side heat exchangers 52*a*, 52*b*, 52*c*, 52*d* is mainly a radiation load is preferably made as quickly as possible. Therefore, it is most appropriate, in terms of suppressing the decrease in operating efficiency, to make the switch from the simultaneous cooling/heating operation mode (balanced evaporation and radiation load) to the simultaneous cooling/heating operation mode (mainly radiation load) at the timing at which the evaporation load in the second heat-source-side heat exchanger 25 functioning as an evaporator of the refrigerant exceeds the radiation load in the first heat-source-side heat exchanger 24 functioning as a radiator of the refrigerant (see FIG. 8).

Therefore, in order to make the switch from the simultaneous cooling/heating operation mode (balanced evaporation and radiation load) to the simultaneous cooling/heating operation mode (mainly radiation load) at the appropriate timing, it is necessary to know the relationship in magnitude between the evaporation load in the second heat-source-side heat exchanger 25 functioning as an evaporator of the refrigerant and the radiation load in the first heat-source-side heat exchanger 24 functioning as a radiator of the refrigerant during the simultaneous cooling/heating operation mode (balanced evaporation and radiation load).

In view of this, heat exchange between the refrigerant flowing through the liquid sides of the heat-source-side heat exchangers 24, 25 is performed by the subcooling heat exchanger 45 as a liquid pipe heat exchanger. In the simultaneous cooling/heating operation mode (balanced evaporation and radiation load), a first liquid pipe temperature Tl1, which is the temperature of the refrigerant on the side of the subcooling heat exchanger 45 that is near the usage-side heat exchangers 52*a*, 52*b*, 52*c*, 52*d*, and a second liquid pipe temperature Tl2, which is the temperature of the refrigerant on the side of the subcooling heat exchanger 45 that is near the heat-source-side heat exchangers 24, 25, are compared, and when the relationship of the first and second liquid pipe temperatures Tl1, Tl2 satisfies an evaporation-switch liquid pipe temperature condition, the first heat-source-side heat exchanger 24 functioning as a radiator of the refrigerant is switched to an evaporator of the refrigerant, i.e., the mode is switched to the simultaneous cooling/heating operation mode (mainly radiation load).

Figure 9:
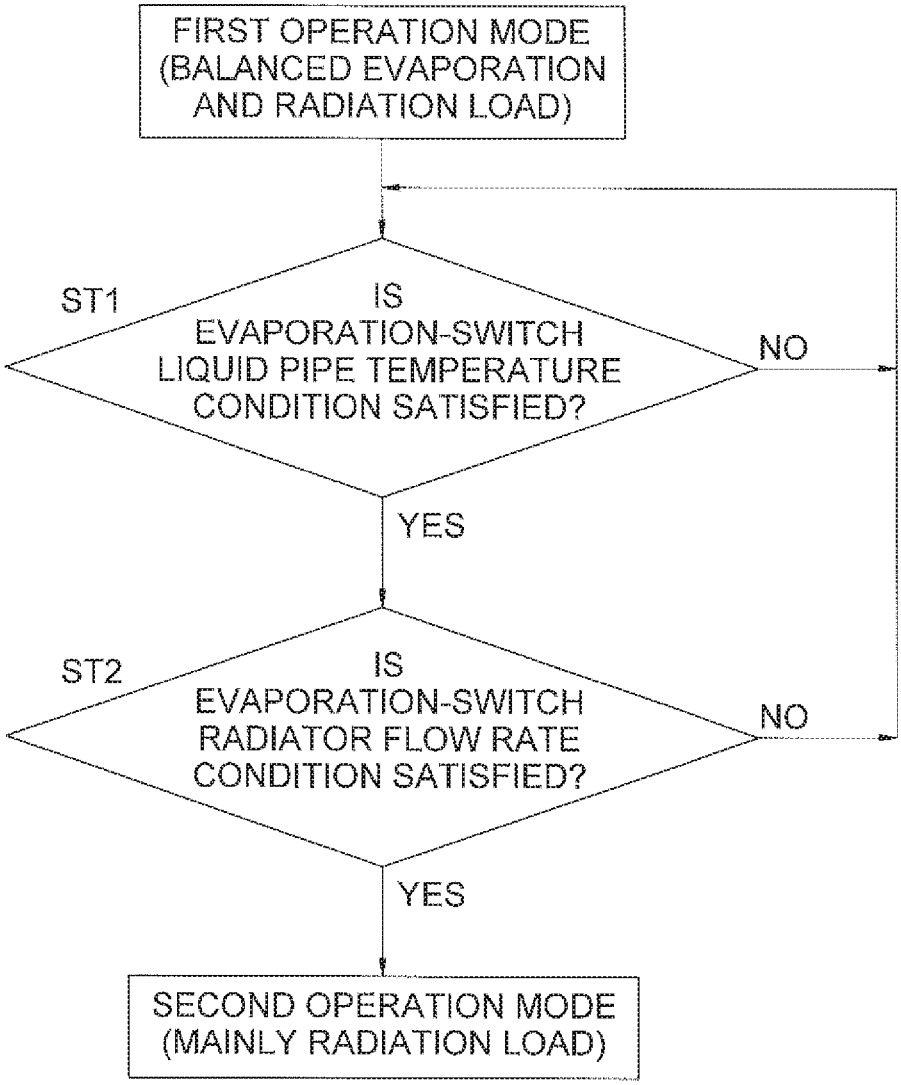
FIG. 9 is a chart illustrating a switch from a first operation mode to a second operation mode.

Next, FIG. 9 is used to describe switching from the simultaneous cooling/heating operation mode (balanced evaporation and radiation load) as the first operation mode to the simultaneous cooling/heating operation mode (mainly radiation load) as the second operation mode. FIG. 9 is a chart illustrating a switch from the first operation mode to the second operation mode. The operation of switching from the first operation mode to the second operation mode is performed by the control parts 20, 50*a*, 50*b*, 50*c*, 50*d*, 60*a*, 60*b*, 60*c*, 60*d*.

First, when the apparatus is operating in the simultaneous cooling/heating operation mode (balanced evaporation and radiation load), in step ST1, the first liquid pipe temperature Tl1, which is the temperature of the refrigerant on the side near the usage-side heat exchangers 52*a*, 52*b*, 52*c*, 52*d* of the subcooling heat exchanger 45 as the liquid pipe heat exchanger, and the second liquid pipe temperature Tl2, which is the temperature of the refrigerant on the side near the heat-source-side heat exchangers 24, 25 of the subcooling heat exchanger 45, are compared, and whether or not the relationship of the first and second liquid pipe temperatures Tl1, 112 satisfies the evaporation-switch liquid pipe temperature condition is determined. In this embodiment, the first liquid pipe temperature Tl1 is detected by the first liquid pipe temperature sensor 80, the second liquid pipe temperature Tl2 is detected by the second liquid pipe temperature sensor 74, and whether or not the evaporation-switch liquid pipe temperature condition is satisfied is determined according to whether or not the first liquid pipe temperature Tl1 is equal to or greater than a value obtained by adding a determining threshold temperature difference ΔT (e.g., 2 to 5° C.) to the second liquid pipe temperature Tl2. In this embodiment, the evaporation-switch liquid pipe temperature condition is an indicator for sensing whether the refrigerant passing through the subcooling heat exchanger 45 is flowing from the side near the usage-side heat exchangers 52*a*, 52*b*, 52*c*, 52*d* toward the side near the heat-source-side heat exchangers 24, 25 (see FIG. 8), or flowing from the side near the heat-source-side heat exchangers 24, 25 toward the side near the usage-side heat exchangers 52*a*, 52*b*, 52*c*, 52*d* (see FIG. 7), from the change in the refrigerant temperature before and after the refrigerant passes through the subcooling heat exchanger 45 as the liquid pipe heat exchanger (first and second liquid pipe temperatures Tl1, Tl2). In this embodiment, the subcooling heat exchanger 45, which is a cooler for cooling the refrigerant flowing between the liquid sides of the heat-source-side heat exchangers 24, 25 and the liquid sides of the usage-side heat exchangers 52*a*, 52*b*, 52*c*, 52*d*, is used as the liquid pipe heat exchanger. Therefore, the temperature of the refrigerant after the refrigerant has passed through the subcooling heat exchanger 45 is lower than the temperature of the refrigerant before the refrigerant passes through the subcooling heat exchanger 45. Therefore, the evaporation-switch liquid pipe temperature condition is that if the first liquid pipe temperature Tl1 on the side near the usage-side heat exchangers 52*a*, 52*b*, 52*c*, 52*d* is equal to or greater than a value obtained by adding the determining threshold temperature difference ΔT to the second liquid pipe temperature Tl2 on the side near the heat-source-side heat exchangers 24, 25, it can be determined that the refrigerant passing through the subcooling heat exchanger 45 is flowing from the side near the usage-side heat exchangers 52*a*, 52*b*, 52*c*, 52*d* toward the side near the heat-source-side heat exchangers 24, 25 (see FIG. 8). In this embodiment, the value obtained by adding the determining threshold temperature difference ΔT to the second liquid pipe temperature Tl2 on the side near the heat-source-side heat exchangers 24, 25 is a threshold value for determining whether or not the evaporation-switch liquid pipe temperature condition is satisfied, but another acceptable option is to determine whether or not the evaporation-switch liquid pipe temperature condition is satisfied by whether or not the first liquid pipe temperature Tl1 is equal to or greater than the second liquid pipe temperature 12, without taking the threshold temperature difference ΔT into account.

When it is determined in step ST1 that the relationship of the first and second liquid pipe temperatures Tl1, Tl2 satisfies the evaporation-switch liquid pipe temperature condition, the evaporation load is judged to be greater than the radiation load in the heat-source-side heat exchangers 24, 25 through the determination process of the hereinafter-described step ST2, and the first heat-source-side heat exchanger 24 functioning as a radiator of the refrigerant is switched to an evaporator of the refrigerant, i.e., a switch is made from the simultaneous cooling/heating operation mode (balanced evaporation and radiation load) to the simultaneous cooling/heating operation mode (mainly radiation load). Thus, the relationship in magnitude between the evaporation load in the second heat-source-side heat exchanger 25 functioning as an evaporator of the refrigerant and the radiation load in the first heat-source-side heat exchanger 24 functioning as a radiator of the refrigerant in the simultaneous cooling/heating operation mode (balanced evaporation and radiation load) is known from the change in the refrigerant temperature before and after the refrigerant passes through the subcooling heat exchanger 45 (the first and second liquid pipe temperatures Tl1, Tl2), and a switch is made from the simultaneous cooling/heating operation mode (balanced evaporation and radiation load) to the simultaneous cooling/heating operation mode (mainly radiation load).

When it is determined in step ST that the relationship of the first and second liquid pipe temperatures Tl1, Tl2 does not satisfy the evaporation-switch liquid pipe temperature condition, the first heat-source-side heat exchanger 21 functioning as a radiator of the refrigerant is not switched to an evaporator of the refrigerant, and the simultaneous cooling/heating operation mode (balanced evaporation and radiation load) is maintained.

Next, in step ST2, a determination is made as to whether or not an evaporation-switch radiator flow rate condition is satisfied. This condition is that a radiator flow rate Gl1, which is the flow rate of the refrigerant passing through the first heat-source-side heat exchanger 24 functioning as a radiator of the refrigerant, be equal to or less than an evaporation-switch radiator flow rate Gl1s.

In this embodiment, in addition to determining whether or not the evaporation-switch liquid pipe temperature condition of step ST1 is satisfied, whether or not the evaporation-switch radiator flow rate condition is satisfied is also determined for the following reason. In the simultaneous cooling/heating operation mode (balanced evaporation and radiation load), the overall heat load of the usage-side heat exchangers 52*a*, 52*b*, 52*c*, 52*d* is small, therefore, the flow rate of the refrigerant passing through the subcooling heat exchanger 45 is low, and there is a risk of erroneous sensing or the like when the first and second liquid pipe temperatures Tl1, Tl2 are sensed by the first and second liquid pipe temperature sensors 80, 74. In the event of this manner of erroneous sensing or the like of the first and second liquid pipe temperatures Tl1, Tl2, there is a risk that in step ST1, the relationship of the first and second liquid pipe temperatures Tl1, Tl2 will be erroneously determined to have satisfied the evaporation-switch liquid pipe temperature condition and there will be an erroneous switch from the simultaneous cooling/heating operation mode (balanced evaporation and radiation load) to the simultaneous cooling/heating operation mode (mainly radiation load).

In view of this, in this embodiment, when not only does the relationship of the first and second liquid pipe temperatures Tl1, Tl2 satisfy the evaporation-switch liquid pipe temperature condition in step ST1 as described above, but the radiator flow rate Gl1, which is the flow rate of the refrigerant passing through the first heat-source-side heat exchanger 24 functioning as a radiator of the refrigerant, also satisfies the evaporation-switch radiator flow rate condition, a switch is made from the simultaneous cooling/heating operation mode (balanced evaporation and radiation load) to the simultaneous cooling/heating operation mode (mainly radiation load) Specifically, the radiator flow rate GL1 is calculated from the temperature and pressure of the refrigerant in the first heat-source-side heat exchanger 24 functioning as a radiator of the refrigerant (e.g., the refrigerant temperature and pressure detected by the first gas-side temperature sensor 76, the first liquid-side temperature sensor 78, and the discharge pressure sensor 73), an opening degree MV1 of the first heat-source-side flow rate adjusting valve 26, and/or other factors, and a determination is made as to whether or not this calculated radiator flow rate GL1 is equal to or less than the evaporation-switch radiator flow rate Gl1s. Moreover, instead of calculating the radiator flow rate GL1, a degree of subcooling SC1 of the refrigerant in the outlet of the first heat-source-side heat exchanger 24 functioning as a radiator of the refrigerant, the opening degree MV1 of the first heat-source-side flow rate adjusting valve 26, and/or other parameters may be used as state quantities equivalent to the radiator flow rate GL1, and the radiator flow rate being equal to or less than the evaporation-switch radiator flow rate Gl1s may be determined by whether or not an equivalent threshold value condition is satisfied. Specifically, in this embodiment, when the radiator flow rate Gl1 (or the equivalent state quantities SC1, MV1, etc.) satisfies the evaporation-switch radiator flow rate condition, the radiator flow rate Gl1 can be judged to be sufficiently low, and the determination that the relationship of the first and second liquid pipe temperatures Tl1, Tl2 satisfies the evaporation-switch liquid pipe temperature condition is therefore determined to be correct. Conversely, when the radiator flow rate Gl1 (or the equivalent state quantities SC1, MV1, etc.) does not satisfy the evaporation-switch radiator flow rate condition, the radiator flow rate Gl1 can be judged to not be sufficiently low, and the determination that the relationship of the first and second liquid pipe temperatures Tl1, Tl2 satisfies the evaporation-switch liquid pipe temperature condition is therefore determined to be erroneous.

Thus, in this embodiment, a switch is made from the simultaneous cooling/heating operation mode (balanced evaporation and radiation load) as the first operation mode to the simultaneous cooling/heating operation mode (mainly radiation load) as the second operation mode.

(4) Characteristics of Heat-Recovery-Type Refrigeration Apparatus (Simultaneous-Cooling/Heating-Operation-Type Air Conditioning Apparatus)

The simultaneous-cooling/heating-operation-type air conditioning apparatus 1 has such features as those described below.

<A>

In this embodiment, as described above, the subcooling heat exchanger 45 as a liquid pipe heat exchanger is provided to conduct heat exchange with the refrigerant flowing through the liquid sides of the plurality of heat-source-side heat exchangers 24, 25. In the simultaneous cooling/heating operation mode (balanced evaporation and radiation load) as the first operation mode, the comparison is made between the first liquid pipe temperature Tl1, which is the temperature of the refrigerant on the side near the usage-side heat exchangers 52*a*, 52*b*, 52*c*, 52*d* in the subcooling heat exchanger 45 as the liquid pipe heat exchanger, and the second liquid pipe temperature Tl2, which is the temperature of the refrigerant on the side near the heat-source-side heat exchangers 24, 25 in the subcooling heat exchanger 45 as the liquid pipe heat exchanger, and when the relationship of the first and second liquid pipe temperatures Tl1, Tl2 satisfies the evaporation-switch liquid pipe temperature condition, the operation mode is switched to the simultaneous cooling/heating operation mode (mainly radiation load) as the second operation mode. When the relationship of the first and second liquid pipe temperatures Tl1, Tl2 does not satisfy the evaporation-switch liquid pipe temperature condition, the simultaneous cooling/heating operation mode (balanced evaporation and radiation load) as the first operation mode is maintained.

In this embodiment, as described above, the subcooling heat exchanger 45 is used as the liquid pipe heat exchanger, this heat exchanger being a cooler for cooling the refrigerant flowing between the liquid sides of the plurality of heat-source-side heat exchangers 24, 25 and the liquid sides of the plurality of usage-side heat exchangers 52*a*, 52*b*, 52*c*, 52*d*. Therefore, the temperature of the refrigerant after the refrigerant has passed through the subcooling heat exchanger 45 is lower than the temperature of the refrigerant before the refrigerant passes through the subcooling heat exchanger 45. Therefore, the evaporation-switch liquid pipe temperature condition is that if the first liquid pipe temperature Tl1 on the side near the usage-side heat exchangers 52*a*, 52*b*, 52*c*, 52*d* is equal to or greater than the second liquid pipe temperature Tl2 on the side near the heat-source-side heat exchangers 24, 25, it can be determined that the refrigerant passing through the subcooling heat exchanger 45 is flowing from the side near the usage-side heat exchangers 52*a*, 52*b*, 52*c*, 52*d* toward the side near the heat-source-side heat exchangers 24, 25. Specifically, in this embodiment, it is possible to use, as the liquid pipe heat exchanger, the subcooling heat exchanger 45, which is a cooler for cooling the refrigerant flowing between the liquid sides of the plurality of heat-source-side heat exchangers 24, 25 and the liquid sides of the plurality of usage-side heat exchangers 52*a*, 52*b*, 52*c*, 52*d*, and to determine whether or not the evaporation-switch liquid pipe temperature condition is satisfied according to the temperature decrease of the refrigerant before-and-after the liquid pipe heat exchanger.

In this embodiment, it is thereby possible, in the simultaneous cooling/heating operation mode (balanced evaporation and radiation load) as the first operation mode in which either one of the plurality of heat-source-side heat exchangers 24, 25 (the first heat-source-side heat exchanger 24 in this case) is caused to function as a radiator of the refrigerant and the other (the second heat-source-side heat exchanger 25 in this case) is caused to function as an evaporator of the refrigerant, for the switch to the simultaneous cooling/heating operation mode (mainly radiation load) as the second operation mode, in which the plurality of heat-source-side heat exchangers 24, 25 are caused to function as evaporators of the refrigerant, to be made at the appropriate timing. Due to the switch from the simultaneous cooling/heating operation mode (balanced evaporation and radiation load) as the first operation mode to the simultaneous cooling/heating operation mode (mainly radiation load) as the second operation mode being made at the appropriate timing, it is possible to suppress the decrease in operating efficiency caused by the simultaneous cooling/heating operation in the simultaneous cooling/heating operation mode (balanced evaporation and radiation load) as the first operation mode.

<B>

In this embodiment, when not only does the relationship of the first and second liquid pipe temperatures Tl1, Tl2 satisfy the evaporation-switch liquid pipe temperature condition as described above, but the radiator flow rate Gl1 (or the equivalent state quantities SC1, MV1, etc), which is the flow rate of the refrigerant passing through the first heat-source-side heat exchanger 24 functioning as a radiator of the refrigerant, also satisfies the evaporation-switch radiator flow rate condition, a switch is made from the simultaneous cooling/heating operation mode (balanced evaporation and radiation load) as the first operation mode to the simultaneous cooling/heating operation mode (mainly radiation load) as the second operation mode.

In this embodiment, the switch from the simultaneous cooling/heating operation mode (balanced evaporation and radiation load) as the first operation mode to the simultaneous cooling/heating operation mode (mainly radiation load) as the second operation mode can thereby be made appropriately without any erroneous determinations.

(5) Modifications

In the above embodiment, the subcooling heat exchanger 45 for cooling the refrigerant flowing between the liquid sides of the plurality of heat-source-side heat exchangers 24, 25 and the liquid sides of the plurality of usage-side heat exchangers 52*a*, 52*b*, 52*c*, 52*d* is employed as the liquid pipe heat exchanger for conducting heat exchange with the refrigerant flowing through the liquid sides of the plurality of heat-source-side heat exchangers 24, 25, but such an arrangement is not provided by way of limitation; any heat exchanger may be employed as long as the heat exchanger conducts heat exchange with the refrigerant flowing through the liquid sides of the plurality of heat-source-side heat exchangers 24, 25.

INDUSTRIAL APPLICABILITY

The present invention is broadly applicable to a heat-recovery-type refrigeration apparatus including a compressor, a plurality of heat-source-side heat exchangers, and a plurality of usage-side heat exchangers, in which a refrigerant is sent from the usage-side heat exchanger functioning as a radiator of the refrigerant to the usage-side heat exchanger functioning as an evaporator of the refrigerant, whereby heat can be recovered between the usage-side heat exchangers.

What is claimed is:

1. A heat-recovery-type refrigeration apparatus comprising:

a compressor;

a plurality of heat-source-side heat exchangers individually switchable between functioning as an evaporator or a radiator of a refrigerant;

a plurality of usage-side heat exchangers individually switchable between functioning as an evaporator or a radiator of the refrigerant, heat recovery between the usage-side heat exchangers being made possible by sending the refrigerant from the usage-side heat exchanger functioning as a radiator of the refrigerant to the usage-side heat exchanger functioning as an evaporator of the refrigerant; and a liquid pipe heat exchanger arranged and configured to cool the refrigerant flowing between liquid sides of the plurality of heat-source-side heat exchangers and liquid sides of the plurality of usage-side heat exchangers, in a first operation mode, in which either one of the plurality of heat-source-side heat exchangers is caused to function as a radiator of the refrigerant while the other is caused to function as an evaporator of the refrigerant, a first liquid pipe temperature, which is a temperature of the refrigerant on a side of the liquid pipe heat exchanger near the usage-side heat exchangers, and a second liquid pipe temperature, which is a temperature of the refrigerant on a side of the liquid pipe heat exchanger near the heat-source-side heat exchangers, are compared, and when a relationship between the first and second liquid pipe temperatures satisfies an evaporation-switch liquid pipe temperature condition, the heat-source-side heat exchanger functioning as a radiator of the refrigerant is switched to an evaporator of the refrigerant and a second operation mode is activated in which the plurality of heat-source-side heat exchangers are caused to function as evaporators of the refrigerant, and the evaporation-switch liquid pipe temperature condition being that the first liquid pipe temperature be equal to or greater than a temperature obtained by adding a threshold temperature difference to the second liquid pipe temperature.

2. The heat-recovery-type refrigeration apparatus according to claim 1, wherein the first operation mode is maintained when the relationship between the first and second liquid pipe temperatures does not satisfy the evaporation-switch liquid pipe temperature condition.

3. The heat-recovery-type refrigeration apparatus according to claim 1, wherein the switch from the first operation mode to the second operation mode is made when an evaporation-switch radiator flow rate condition is satisfied, the evaporation-switch radiator flow rate condition being either that a radiator flow rate, which is a flow rate of the refrigerant passing through the heat-source-side heat exchanger functioning as a radiator of the refrigerant, is equal to or less than an evaporation-switch radiator flow rate, or a state quantity equivalent to the radiator flow rate, which is a value equivalent to the radiator flow rate, is equal to or less than the evaporation-switch radiator flow rate, and the relationship between the first and second liquid pipe temperatures satisfies the evaporation-switch liquid pipe temperature condition.

4. The heat-recovery-type refrigeration apparatus according to claim 2, wherein the switch from the first operation mode to the second operation mode is made when an evaporation-switch radiator flow rate condition is satisfied, the evaporation-switch radiator flow rate condition being either that a radiator flow rate, which is a flow rate of the refrigerant passing through the heat-source-side heat exchanger functioning as a radiator of the refrigerant, is equal to or less than an evaporation-switch radiator flow rate, or a state quantity equivalent to the radiator flow rate, which is a value equivalent to the radiator flow rate, is equal to or less than the evaporation-switch radiator flow rate, and the relationship between the first and second liquid pipe temperatures satisfies the evaporation-switch liquid pipe temperature condition.

* * * * *